US011447378B2

(12) United States Patent
Huddleston et al.

(10) Patent No.: US 11,447,378 B2
(45) Date of Patent: Sep. 20, 2022

(54) ACCESS DECK ASSEMBLY AND HANDLE ASSEMBLY FOR AN AERIAL WORK PLATFORM OF A VEHICLE

(71) Applicant: Terex South Dakota, Inc., Watertown, SD (US)

(72) Inventors: Reuben Huddleston, Moses Lake, WA (US); Chad Hislop, Redmond, WA (US); Adam Hailey, Kirkland, WA (US); Jim Donaldson, Puyallup, WA (US); Dax Wells, Moses Lake, WA (US); Dave Hubbell, Cranberry Township, PA (US); Max Wallner, Woodinville, WA (US); Jonathan Sebastian, Renton, WA (US); Kenneth Higuera Lyons, Sultan, WA (US); Trel Lynn Dutton, Kirkland, WA (US)

(73) Assignee: Terex South Dakota, Inc., Watertown, SD (US)

( * ) Notice: Subject to any disclaimer, the term of this patent is extended or adjusted under 35 U.S.C. 154(b) by 0 days.

(21) Appl. No.: 16/715,251

(22) Filed: Dec. 16, 2019

(65) Prior Publication Data

US 2020/0189892 A1 Jun. 18, 2020

Related U.S. Application Data

(60) Provisional application No. 62/804,953, filed on Feb. 13, 2019, provisional application No. 62/780,484, filed on Dec. 17, 2018.

(51) Int. Cl.
*B66F 13/00* (2006.01)
*B66F 11/04* (2006.01)
(Continued)

(52) U.S. Cl.
CPC ..... *B66F 13/00* (2013.01); *B66F 11/04* (2013.01); *E04G 1/22* (2013.01); *E04G 5/00* (2013.01);
(Continued)

(58) Field of Classification Search
CPC . B66F 13/00; B66F 11/04; E04G 1/22; E04G 5/00; E04G 5/10; E04G 9/08; E04G 9/10
(Continued)

(56) References Cited

U.S. PATENT DOCUMENTS 366,365 A 7/1887 Averberg
656,946 A * 8/1900 Corduan ..... E06C 1/39 182/123
(Continued)

FOREIGN PATENT DOCUMENTS

CN 207618972 U 7/2018
EP 2479135 A1 7/2012

OTHER PUBLICATIONS

Man Lift Mfg Co, "Owner's Manual—SHU-30—Vertical Access Platform Attachment", Aug. 16, 2013, 36 pages.
(Continued)

*Primary Examiner* — Daniel P Cahn
*Assistant Examiner* — Shiref M Mekhaeil
(74) *Attorney, Agent, or Firm* — Brooks Kushman P.C.

(57) ABSTRACT

An access deck assembly is provided for an aerial lift vehicle mobile platform. A base member defines an upper surface to support an operator, and has first and second guides to cooperate with the platform. A locking mechanism is supported by the base member and retains the access deck to the platform. A method of connecting an access deck assembly to a mobile platform is provided. The access deck assembly is positioned relative to the platform to be above and spaced apart from the platform floor surface, with the base member
(Continued)

of the access deck assembly substantially within a perimeter frame of the platform. An access deck assembly has a guide member connected to a base member and configured to connect the base member to the mobile platform and support the base member directly above and spaced apart from the platform floor surface.

18 Claims, 23 Drawing Sheets

(51) Int. Cl.
*E06C 9/10* (2006.01)
*E06C 9/08* (2006.01)
*E04G 1/22* (2006.01)
*E04G 5/00* (2006.01)
*E04G 5/10* (2006.01)

(52) U.S. Cl.
CPC ..... *E04G 5/10* (2013.01); *E06C 9/08* (2013.01); *E06C 9/10* (2013.01)

(58) Field of Classification Search
USPC ..... 248/235, 239, 240; 211/119.005, 211/119.006, 119.007, 119.008; 108/47, 108/49
See application file for complete search history.

(56) References Cited

U.S. PATENT DOCUMENTS 922,306 A * 5/1909 Mead ..... E06C 7/182 182/123
1,439,388 A * 12/1922 Willett ..... E06C 1/393 182/15
1,439,419 A * 12/1922 James ..... E06C 1/393 182/228.1
2,257,211 A * 9/1941 Willoughby ..... B60N 2/3047 297/14
2,581,488 A * 1/1952 Keltner ..... E06C 9/08 182/77
2,749,008 A * 6/1956 Wilson ..... E06C 7/16 182/216
2,798,652 A * 7/1957 Easton ..... E06C 1/24 182/15
3,030,166 A 4/1962 Richards et al.
3,112,010 A * 11/1963 Mihalik ..... E06C 1/397 182/15
3,476,256 A * 11/1969 Anderson ..... A61G 13/10 248/173
3,596,735 A 8/1971 Denier et al.
3,664,458 A * 5/1972 Sterns ..... E06C 1/39 182/180.2
4,009,903 A 3/1977 Manspeaker
4,064,999 A 12/1977 Young
4,157,129 A 6/1979 Christopher
4,356,887 A 11/1982 Fisher et al.
4,494,465 A 1/1985 Fick, Jr.
4,503,932 A * 3/1985 Hilton ..... E06C 7/14 182/113
4,558,847 A 12/1985 Coates
4,620,611 A * 11/1986 Good ..... E06C 7/182 182/116
4,883,145 A 11/1989 Deltatto
5,072,955 A * 12/1991 Holland ..... B25H 1/16 182/116
5,085,290 A * 2/1992 Guirlinger ..... A47C 9/06 182/91
5,094,515 A 3/1992 Low
5,152,486 A * 10/1992 Kabanek ..... A61B 90/60 5/507.1
5,158,023 A 10/1992 Allen
5,240,214 A * 8/1993 Birnbaum ..... F16M 11/12 248/214
5,297,844 A 3/1994 Haustein
5,330,245 A 7/1994 Boisset
5,358,067 A 10/1994 Ford et al.
5,381,872 A 1/1995 Peruzzi et al.
5,427,438 A * 6/1995 Fochs ..... A61H 3/04 297/344.18
5,544,718 A * 8/1996 Schumacher ..... E06C 7/14 182/141
5,547,205 A * 8/1996 do Rosario Sousa de Cabedo ..... B62B 5/085 297/14
5,655,459 A * 8/1997 O'Connor ..... A47B 5/06 108/134
5,662,368 A 9/1997 Ito et al.
5,868,218 A 2/1999 Lawson
5,904,168 A * 5/1999 Alulyan ..... A61H 3/00 135/65
5,967,255 A * 10/1999 Young ..... A47B 5/06 297/14
6,044,927 A 4/2000 Newlin
6,105,721 A 8/2000 Haynes
6,431,632 B1 8/2002 Kozikowksi et al.
6,786,162 B1 * 9/2004 Volkmer ..... A47B 5/06 108/115
6,902,034 B2 * 6/2005 Gibson ..... E04G 5/003 182/152
7,353,911 B1 * 4/2008 Freeman ..... E04G 5/06 248/238
7,448,470 B2 * 11/2008 Brown ..... B66F 11/042 182/69.5
8,267,222 B2 9/2012 Cui
8,490,747 B2 * 7/2013 Winslow ..... E04G 5/003 182/119
8,505,684 B1 8/2013 Bogue
8,651,237 B2 2/2014 Pulliam
8,800,717 B2 8/2014 Berry, Jr. et al.
9,016,434 B2 * 4/2015 Moss ..... E06C 1/397 182/180.1
9,108,831 B2 8/2015 Beji
9,500,029 B1 * 11/2016 Mullins ..... E06C 5/04
9,617,788 B2 * 4/2017 Goodson ..... E06C 1/005
9,883,741 B2 * 2/2018 Demasi, III ..... A47B 46/005
10,118,556 B2 * 11/2018 Pine ..... E06C 5/02
10,322,920 B2 6/2019 Shi
D856,623 S 8/2019 Jilbert
D859,773 S 9/2019 Beamish et al.
10,718,120 B1 * 7/2020 Haney ..... E04G 5/003
10,801,262 B2 * 10/2020 Johansson ..... E06C 7/185
2003/0070702 A1 * 4/2003 Ownes ..... A61H 3/00 135/74
2005/0056484 A1 3/2005 Fredette
2007/0187184 A1 8/2007 Nasuti et al.
2007/0257586 A1 * 11/2007 Gonzalez ..... B66F 11/04 312/308
2008/0030037 A1 2/2008 Lombardi
2008/0105498 A1 5/2008 Perkins
2008/0149420 A1 6/2008 Cheatham
2008/0302601 A1 12/2008 Baker
2009/0218166 A1 * 9/2009 Newton ..... E04G 5/003 182/129
2011/0209945 A1 * 9/2011 Gealy ..... E04G 5/00 182/222
2012/0042458 A1 * 2/2012 Bennett ..... B66F 11/04 14/71.3
2012/0186908 A1 7/2012 Crook et al.
2012/0217091 A1 8/2012 Baillargeon et al.
2013/0075203 A1 * 3/2013 Sayles ..... B66F 11/04 187/390
2013/0186710 A1 * 7/2013 Moss ..... E06C 7/185 182/104
2013/0206508 A1 * 8/2013 Rushlow ..... E04G 1/18 206/557
2013/0326808 A1 * 12/2013 Saint ..... A47D 13/063 5/93.1
2014/0020978 A1 1/2014 Weston

(56) References Cited

U.S. PATENT DOCUMENTS

| | | | | |
|---|---|---|---|---|
| 2014/0084641 | A1* | 3/2014 | Moody | A47C 15/004 297/16.1 |
| 2015/0021284 | A1* | 1/2015 | Ashley | A47B 23/04 403/345 |
| 2015/0224936 | A1* | 8/2015 | Kichline, Jr. | B60R 3/02 182/84 |
| 2016/0069094 | A1 | 3/2016 | Lombardi et al. | |
| 2016/0138338 | A1 | 5/2016 | Olson | |
| 2017/0202727 | A1* | 7/2017 | Wegener | A61H 3/00 |
| 2017/0226803 | A1* | 8/2017 | Russell | E06C 7/182 |
| 2018/0057333 | A1 | 3/2018 | Gale et al. | |
| 2018/0251354 | A1 | 9/2018 | Mohlman et al. | |
| 2019/0078385 | A1* | 3/2019 | Moss | E06C 1/397 |
| 2019/0309901 | A1 | 10/2019 | Crook | |
| 2019/0330034 | A1* | 10/2019 | Crook | B66F 13/00 |
| 2019/0330920 | A1* | 10/2019 | Boyer | E06C 1/383 |
| 2020/0003607 | A1 | 1/2020 | Bafile et al. | |
| 2020/0224437 | A1* | 7/2020 | Curtis | E04G 7/34 |
| 2020/0317489 | A1 | 10/2020 | Bhatia et al. | |
| 2020/0325726 | A1* | 10/2020 | Yoo | E06C 1/393 |
| 2021/0010327 | A1* | 1/2021 | Boyer | E06C 1/22 |
| 2021/0017774 | A1* | 1/2021 | Phan | E04G 1/00 |

OTHER PUBLICATIONS

International Search Report and Written Opinion for Application No. PCT/US19/66511, dated Feb. 27, 2020, 10 pages.
International Preliminary Report on Patentability for PCT No. PCT/US2019/066511, dated Jul. 1, 2021, 8 pages.

* cited by examiner

ACCESS DECK ASSEMBLY AND HANDLE ASSEMBLY FOR AN AERIAL WORK PLATFORM OF A VEHICLE

CROSS-REFERENCE TO RELATED APPLICATIONS

This application claims the benefit of U.S. provisional application Ser. No. 62/780,484 filed Dec. 17, 2018 and U.S. provisional application Ser. No. 62/804,953 filed Feb. 13, 2019, the disclosures of which are hereby incorporated in their entirety by reference herein.

TECHNICAL FIELD

Various embodiments relate to a raised access deck assembly and an associated handle assembly for use with an aerial work platform on a vehicle.

BACKGROUND

Aerial lift platforms provide a floor or surface for an operator to stand on. In certain special access conditions, an operator may be unable to reach or otherwise access a desired object or work area, for example, when the aerial lift platform cannot be raised further based on clearance issues or when the aerial lift platform has reached an end of its available range of movement.

SUMMARY

In an embodiment, an access deck assembly for a mobile platform on an aerial lift vehicle is provided with a base member extending from a first end to a second opposite end. The base member defines an upper surface sized to support an operator thereon. A first guide is supported by the base member, and the first guide is sized to cooperate with a first portion of the mobile platform. A second guide is supported by the base member, and the second guide is sized to cooperate with a second portion of the mobile platform. A locking mechanism is supported by the base member. The locking mechanism is movable to an engaged position to retain the second portion of the mobile platform between the locking mechanism and the second guide.

In a further embodiment, the locking mechanism includes a latch member rotatably supported by the base member, with the latch member having an aperture therethrough. The locking mechanism includes a spring-loaded pin supported by the base member. The pin extends through the aperture in the latch member to position the locking mechanism in the engaged position by positioning the latch member across an opening to a channel formed by the second guide. The channel is sized to receive the second portion of the mobile platform.

In another further embodiment, the locking mechanism has a latch member and a spring member. The latch member is supported for translation relative to the base member and movable from an engagement position to a disengagement position. The spring member biases the latch member towards the engagement position.

In an even further embodiment, the latch member defines an inclined face shaped to cooperate with the mobile platform to move the latch member to the disengagement position in response to the inclined face contacting the mobile platform.

In a further embodiment, a step is rotatably connected to the base member.

In an even further embodiment, a step locking mechanism is provided to cooperate with the step to locate the step in each of a storage position and a use position.

In another further embodiment, a handle assembly is connected to the base member.

In an even further embodiment, the handle assembly has first and second legs, a cross-member extending between and connected to the first and second legs, a hanging bracket supported by the cross-member, and an upper handle rotatably connected to the first and second legs. The hanging bracket is sized to cooperate with an upper perimeter rail of the mobile platform.

In a yet further embodiment, the handle assembly has a first storage position, a second upright position with the upper handle adjacent to the first and second legs, and a third use position with the upper handle extending outwardly from the first and second legs for grasping by an operator. A locking pin is supported by the base member and configured to cooperate with the first leg to selectively retain the handle assembly in the first position or the second position.

In a further embodiment, a handle assembly is provided to connect to an upper rail of the mobile platform.

In an even further embodiment, the handle assembly has a support bracket with a first connection point to connect to the upper rail of the mobile platform and a second connection point to connect to a vertical frame member of the mobile platform. The handle assembly has a handle rotatably connected to the support bracket to move between a use position and a storage position.

In another further embodiment, the first portion and second portion of the mobile platform are provided by a mid-perimeter rail. The first guide forms a channel sized to receive the first portion of the mid-perimeter rail of the mobile platform.

In an even further embodiment, the second guide forms another channel sized to receive the second portion of the mid-perimeter rail of the mobile platform.

In another even further embodiment, the second guide defines a locating feature configured to cooperate with the second portion of the mobile platform to locate the access deck assembly.

In a further embodiment, the first guide limits translational movement of the access deck assembly relative to the mobile platform along a first axis. The second guide limits translational movement of the access deck assembly relative to the mobile platform along a second axis.

In an even further embodiment, an anchor bracket is provided and sized to receive a vertical frame member of the mobile platform and limit translational movement of the access deck assembly relative to the mobile platform along a third axis.

In another embodiment, an access deck assembly for a mobile platform on an aerial lift vehicle is provided. The assembly has a base member extending from a first end to a second opposite end, with the base member defining an upper surface sized to support an operator thereon. At least one guide member is connected to the base member, and the at least one guide member configured to connect the base member to the mobile platform and configured to support the base member directly above a floor surface of the mobile platform and spaced apart therefrom.

In a further embodiment, the at least one guide member is configured to connect to a mid-perimeter rail of the mobile platform, an upper rail of the mobile platform, or a lower toe guard of the mobile platform.

In another further embodiment, the assembly has a support member connected to the base member and configured to extend from the base member to the mobile platform at a location offset vertically from the base member. In one example, the support member may extend to the floor surface of the mobile platform.

In an even further embodiment, the support member is rotatably connected to the base member and moveable from a use position in contact with the location of the mobile platform to a storage position spaced apart from the location of the mobile platform.

In a further embodiment, a handle assembly is supported by the mobile platform adjacent to the base member and vertically offset therefrom, with the handle assembly extending from the mobile platform away from the base member.

In an even further embodiment, the handle assembly is moveable relative to the mobile platform from a retracted position to an extended position.

In another further embodiment, a toe guard extends along at least a portion of a perimeter of the base member.

In a further embodiment, the at least one guide member limits translational movement of the access deck assembly relative to the mobile platform along an axis.

In an embodiment, a method of connecting an access deck assembly to a mobile platform of an aerial lift vehicle is provided. An access deck assembly is provided with a base member connected to at least one guide member, with the base member extending from a first end to a second opposite end. The base member defines an upper surface sized to support an operator thereon. The access deck assembly is positioned relative to the mobile platform such that the base member is above a floor surface of the mobile platform and spaced apart therefrom, and the base member is substantially within a perimeter frame the mobile platform. The at least one guide member is connected to the mobile platform.

In a further embodiment, a handle assembly is connected to an upper rail of the mobile platform.

In another further embodiment, a handle assembly is moved from a first storage position to a second use position for grasping by an operator by translating the handle assembly relative to the base member.

In a further embodiment, a step is moved from a storage position to a use position, the step rotatably connected to the base member.

In another further embodiment, the at least one guide member is connected to the mobile platform by sliding a first portion of a mid-perimeter rail of the mobile platform into a channel defined by a first guide of a base member of the access deck assembly, lowering the base member until a second portion of the mid-perimeter rail cooperates with a second guide of the base member, and engaging a locking mechanism of the access deck assembly to retain the mid-perimeter rail relative thereto.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
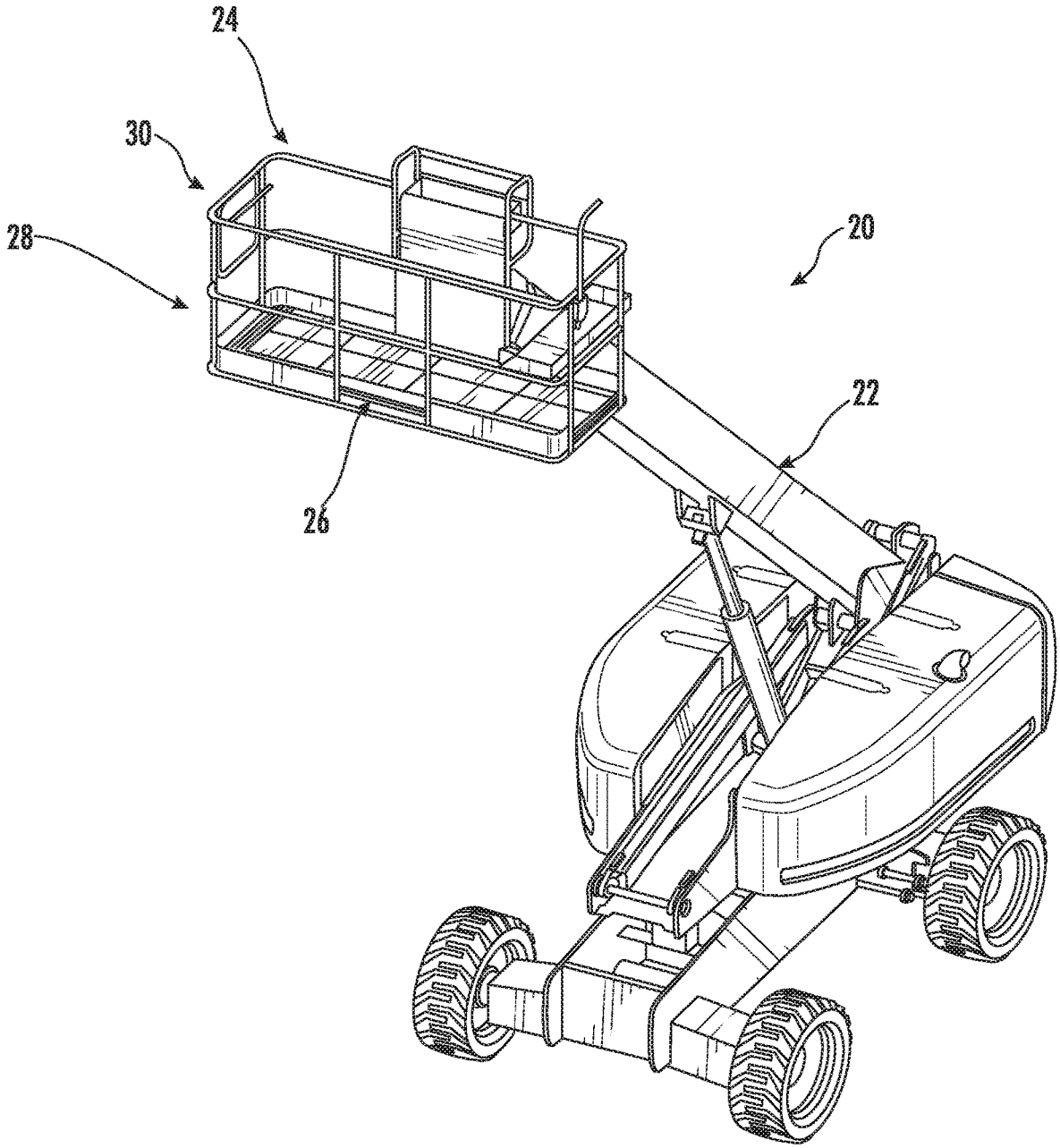
FIG. 1 is a perspective view of an aerial lift according to an embodiment.

FIG. 1 illustrates a land vehicle according to an embodiment and depicted as an aerial lift 20. The aerial lift 20 is mobile and includes an articulated arm 22 for transporting and lifting a mobile work platform assembly 24, often referred to as a basket. The aerial lift 20 may be another utility vehicle with a mobile work platform assembly such as an aerial work platform, a rough terrain telescopic load handler, portable material lift, telehandler, scissor lift, telescopic and articulating boom, and the like. The vehicle 20 is configured for lifting a load, such as a person, tools, cargo, and the like, with respect to an underlying support surface, such as paved or unpaved ground, a road, an apron such as a sidewalk or parking lot, an interior or exterior floor of a structure, or other surfaces. Traction devices, such as wheels, support the vehicle on the underlying surface.

Figure 2:
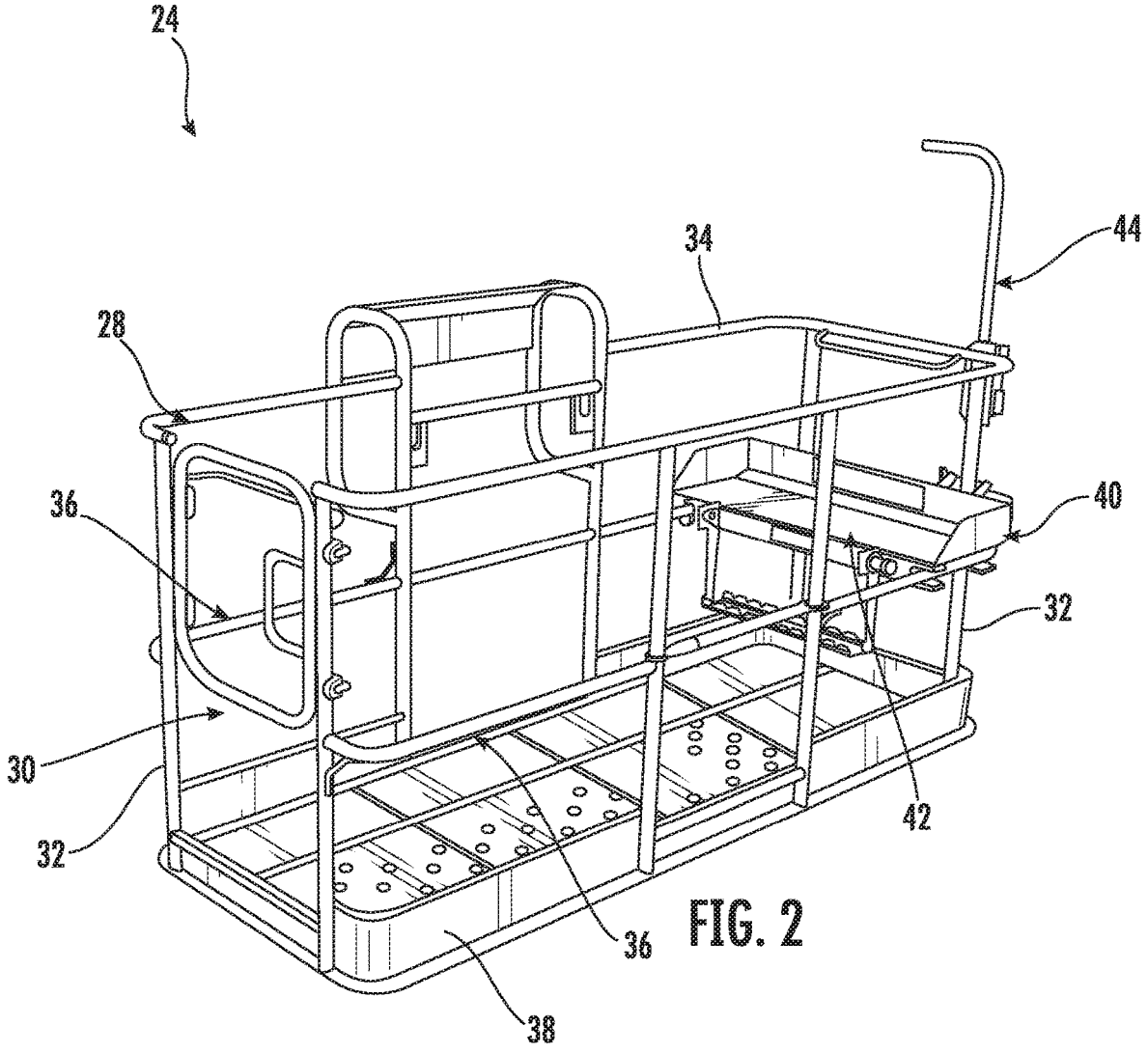
FIG. 2 is a front perspective view of a mobile work platform of the aerial lift of FIG. 1, according to another embodiment.

FIG. 2 illustrates the mobile work platform assembly 24 of FIG. 1 in greater detail. With reference to FIGS. 1-2, the mobile work platform assembly 24 includes a platform 26 sized to receive one or more operators or users upon the platform 26, e.g. as a floor of the assembly 24. A perimeter frame assembly 28 is provided upon the platform 26. The frame assembly 28 provides a frame of guard rails that extend around a perimeter of the platform 26 to contain an operator within the frame assembly 28. A door 30 is provided upon the frame assembly 28 to permit operator ingress to, and egress from, the frame assembly 28.

The frame assembly 28 includes a series of vertical support members 32 with an upper rail 34 extending about an outer perimeter of the platform 26. The frame assembly 28 additionally has an intermediate rail 36, or mid-perimeter rail, positioned between the upper rail 34 and the platform 26 and extending about an outer perimeter of the platform 26. A lower guard 38 may additionally be provided on the mobile work platform assembly 24 as shown. The frame assembly 28 provides a railing for an operator in the mobile work platform assembly 24.

An aerial lift 20 is commonly used for translating and lifting an operator to an otherwise, difficult to reach work location. Such work locations are often elevated above ground and may require special access beyond that available to an operator standing on the platform 26. In order for an operator to work in a special access condition, the operator may need to be elevated above a position available when standing on the platform 26 surface. For example, the mobile work platform assembly 24 may be raised to a point where there is no additional clearance to raise the platform, or until a maximum vertical travel of the assembly 24 has been reached. An access deck assembly 40 is provided for use with the aerial lift 20 for providing a raised surface relative to the platform 26 for the operator to stand on or otherwise use when the operator needs to be at a position above that allowed by the platform 26 surface. The access deck assembly 40 is connected to and fixed relative to the assembly 24 to provide a stable and secure work surface for the operator. Conventionally, an operator has used a stepstool placed onto and not connected to the assembly 24 or has stood directly on a member of the frame 28, which does not provide a stable or secure position for the operator on the aerial lift 20.

The access deck assembly 40 is provided on the interior of frame assembly 28. The access deck assembly 40 is detachably connected and secured to the frame assembly 28 and the mobile work platform assembly 24, such that it is movable to different locations within the platform assembly 24, or may be completely removed at certain times for storage. As shown in FIG. 2, the access deck assembly 40 includes an access platform 42 mounted to the interior of frame assembly 28 and raised relative to the platform 26 surface for an operator to stand upon for a special access condition.

In various embodiments, one or more support handle assemblies 44 may additionally be provided. The support handle 44 provides a three-point balance support or grasping point for the operator when the operator is entering, leaving, or otherwise using the access deck assembly 40. An example of a support handle assembly according to the present disclosure is described below in further detail with reference to FIGS. 8-11. In other examples, the access deck assembly 40 and handle assembly 44 may be used with the vehicle 220 as described below.

Referring to FIGS. 1-2, the access deck assembly 40 extends across the platform assembly, e.g. between frame members on opposite sides of the platform. Although one length of the access deck assembly 40 is illustrated, any suitable access deck length is contemplated, and the length of the access deck assembly 40 may be selected based on the size of the platform assembly 24. Although one access deck assembly 40 is illustrated, multiple access deck assemblies 40 may be utilized, e.g. to provide multiple special access points for more than one operator, or to provide one operator with multiple special access points to move between during a job.

FIGS. 3-7 illustrate an access deck assembly 40 according to another embodiment. In various embodiments, the access deck assembly 40 may be used with the aerial lift 20 and mobile work platform assembly 24 of FIGS. 1-2. For convenience, elements that are the same or similar to those shown in FIGS. 1-2 are given the same reference number. The access deck assembly 40 is detachably connected and secured to the frame 28 of the mobile work platform assembly 24 to prevent movement of the access deck assembly 40 relative to the mobile work platform 24. The access deck assembly 40 may be easily disconnected from the frame 28 by the operator to move the access deck assembly 40 to another location, or for storage of the access deck assembly 40.

The access deck assembly 40 includes a base member 50 or substrate 50. In one example, the base member 50 may be formed or welded from suitable strength materials, such as aluminum alloys. In other examples, the base member 50 may be formed from another material.

The base member 50 is sized to have a length to extend across the mobile work platform 24. A first end 52 of the base member cooperates with the mid-perimeter rail on one side of the mobile work platform, while the second, opposite end 54 of the base member cooperates with the mid-perimeter rails on the other side of the mobile work platform.

The base member has an upper surface 56 and a lower surface opposite to the upper surface. The upper surface 56 may have a tread pattern formed therein or may have an anti-skid coating.

The base member 50 has a pair of sidewalls 58 that extend outwardly and downwardly from the base member 50, and are connected to the lower surface. The sidewalls 58 may extend longitudinally between the first and second ends of the base member 50 as shown. The sidewalls 58 may be separately formed and connected to the substrate using fasteners or a joining method such as welding. In other examples, the sidewalls 58 may be integrally formed with the substrate, and shaped using a stamping process or the like.

At least one hanger guide 60 is provided on the first end of the base member 50. In the present example, a pair of hanger guides 60 are provided and connected to the base member 50. In alternative examples, a single, elongated hanger guide 60 may be provided and extend along the first end of the base member 50, or more than two hanger guides may be provided. The hanger guides 60 each form a channel that is sized to receive a portion of the mid-perimeter rail. The channel and hanger guide 60 may be elongated, for example, along a longitudinal direction of the base member. For example, the length of each channel in the hanger guide 60 may be greater than a diameter of the mid-perimeter rail, and in a further example, the length of each channel is more than twice the diameter of an associated mid-perimeter rail.

Figure 7:
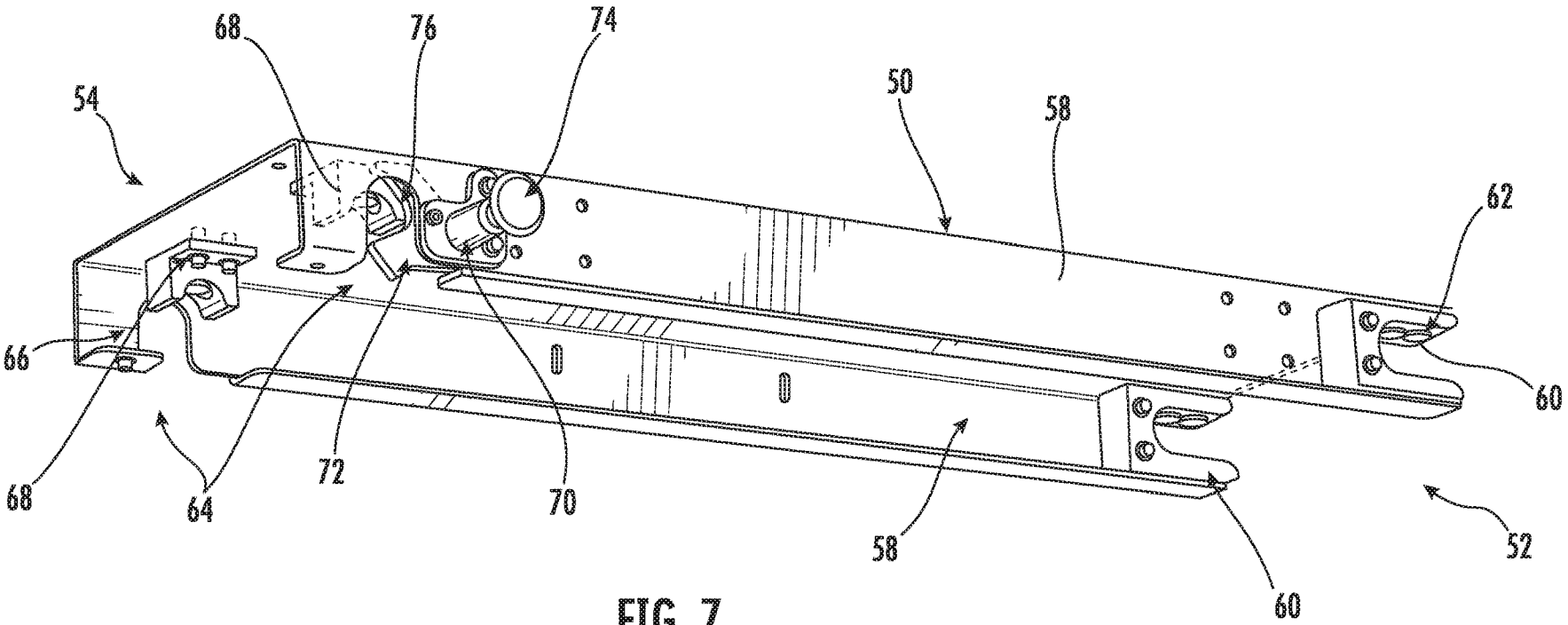
FIG. 7 is a detailed partial view of the access deck assembly of FIG. 3.

The hanger guides 60 are sized and shaped to receive a portion of the mid-perimeter rail 36 (as shown in FIG. 2) of the mobile work platform assembly 24. The hanger guides 60 are connected to the substrate 50 or sidewalls 58, and in one example, are connected using fasteners, such as threaded bolts and nuts. The hanger guides 60 may be formed from a resilient material, such as a rubber. In alternative examples, the hanger guides 60 may be formed from a metal, and may additionally have a rubberized or other resilient coating on the channel walls. In a further example, and as shown, the sidewall 58 may be provided with a channel shaped end 62 that corresponds with and is aligned with the channel of the hanger guide 60. The hanger guides 60 are shown as being mounted directly to the substrate 50 and an inboard side of the associated sidewall 58. An alternative view of the hanger guides 60 is illustrated in FIG. 7.

At least one support guide 64 is provided on the second end 54 of the base member 50. In the present example, a pair of support guides 64 are provided and connected to the base member 50. In alternative examples, a single, elongated support guide 64 may be provided and extend along the second end of the base member 50, or more than two support guides may be provided. The support guides 64 each form a channel that is sized to receive a portion of the mid-perimeter rail. The channel and support guide 64 may be sized to be greater than a diameter of the mid-perimeter rail.

In the example shown, each of the sidewalls defines a channel 66 adjacent to the second end of the base member 50 to provide the support guide. Additionally a tube guide 68 is connected to the base member to form a secondary channel for the support guide. The tube guide 68 may be formed as a two-piece structure as shown with a plastic or metal material forming the secondary channel, and a resilient or rubber material positioned in and protruding from the base region of the channel to provide a bumper or cushion member and also provide a higher friction interface with the mid-perimeter frame member. The tube guide 68 may be connected to the base member 50 using fasteners, such as bolts and nuts.

A locking mechanism 70 is provided with the support guides 64. In the example shown, a single locking mechanism 70 is provided for one of the support guides. In other examples, more than one locking mechanism may be provided. The locking mechanism 70 has a latch member 72 that is rotatably connected to the side wall adjacent to the channel 66, for example, via pivot pin or the like. An aperture is formed through the latch member 72. A spring-loaded pull pin 74 is connected to the sidewall 58, and is configured such that the pin engages the aperture in the latch member to retain the latch member is the locked position as shown in FIG. 7. When the pull pin is pulled with sufficient force to overcome the biasing force of the spring, the pin is pulled out of the aperture in the latch member 72, and the latch member rotates (counterclockwise in FIG. 7) such that the channel-shaped surface 76 of the latch member faces generally downwardly. The latch member 72 is weighted and designed with a center of gravity such that it rotates to open the locking mechanism when the spring-loaded pull pin is activated. The latch member 72 contacts the sidewall 58 when it is in an open position to prevent over-rotation, and is also limited in motion in the engaged position to aid in alignment of the pull pin with the aperture and engaging the lock. The locking mechanism 70 is therefore movable between a released position and self-locking position (as shown).

The access deck assembly 40 includes a toe guard 80 extending around at least a portion of the perimeter of the base member 50. In one example, and as shown, the toe guard 80 extends around three sides of the base member 50, and is connected or fastened to the base member 50.

An anchor bracket 82 may be connected to or extend from the toe guard 80, for example, using fasteners, via a weld, or the like. In alternative examples, the anchor bracket 82 may be directly connected to the base member 50 or a sidewall 58. The anchor bracket 82 has a pair of bracket arms 84 that are spaced apart from one another and are sized to receive a vertical frame member. A locking pin 86 is provided that extends through apertures in each of the bracket arms and connects to the pair of bracket arms to retain the vertical frame member within the anchor bracket. The locking pin may be a quick release ball locking pin, a pin with a folding latch end, a wire lock pin provided by a clevis pin with an attached wire loop, or another locking mechanism. The locking pin may be connected to the access deck via a leash 88.

The channels of the hanger guides 60 on the first end of the base member 50 extend transversely, while the channels of the support guides extend vertically. Therefore, when the access deck assembly is installed onto the perimeter frame, the channels of the hanger guides 60 and the locking mechanism prevent the access deck from moving in a vertical direction or limit translational movement along a first axis, the channels of the support guides prevent the access deck from moving in a longitudinal direction or limit translational movement along a second axis, and the anchor bracket prevents the access deck from moving in a transverse direction relative to the mobile work platform or limit translational movement along a third axis. The access deck is therefore connected to the mobile work platform and has zero degrees of freedom. The first, second, and third axis may be orthogonal to one another.

A pair of cross bars 90 may be provided between and connect the two sidewalls 58, for example, to increase the structural rigidity of the sidewalls. In a further example, additional cross bars may be provided, for example, in an intermediate location of the base member 50.

Figure 3:
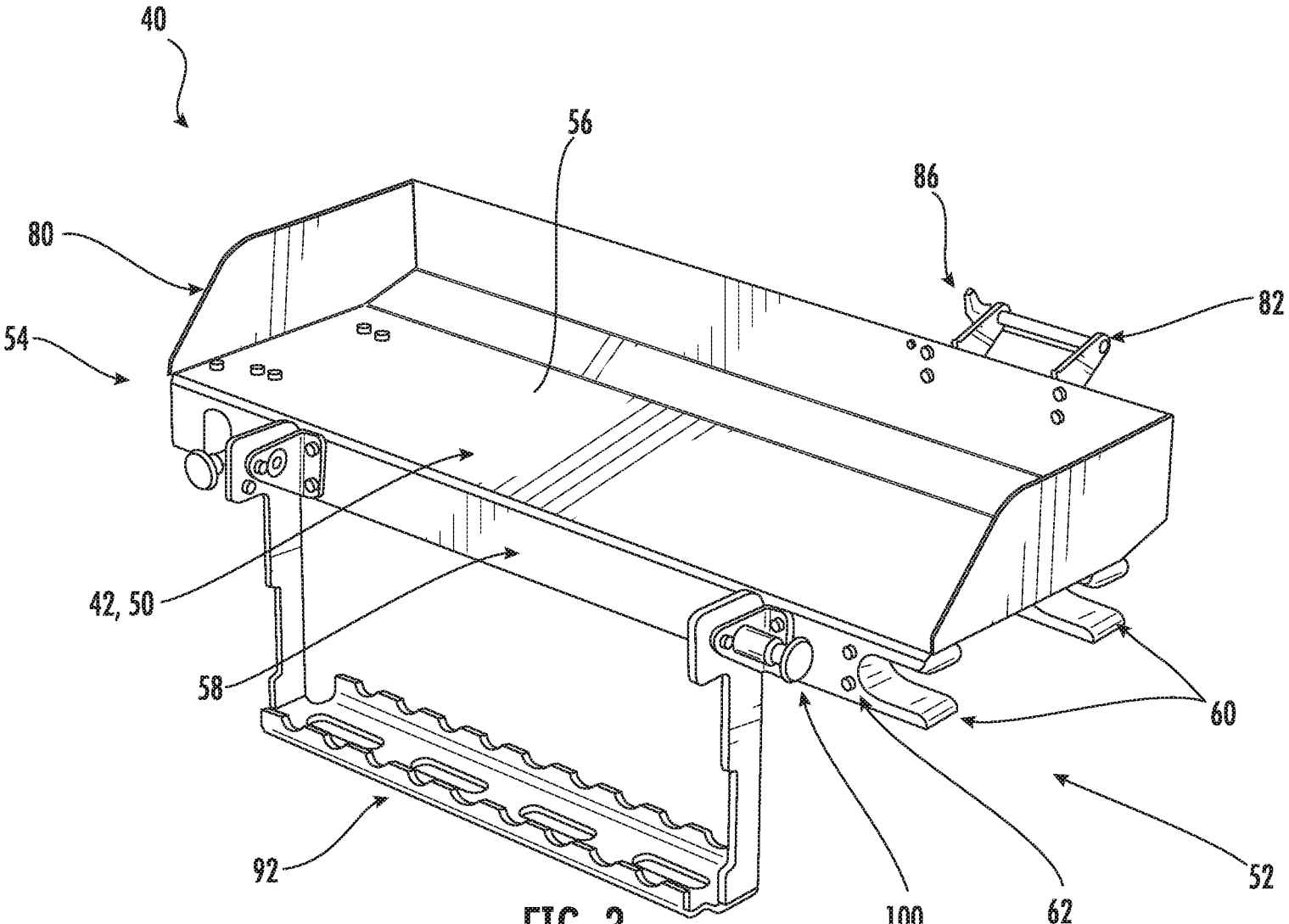
FIG. 3 is front perspective view of an access deck assembly according to an embodiment and for use with the mobile work platform of FIGS. 1 and 2.
Figure 5:
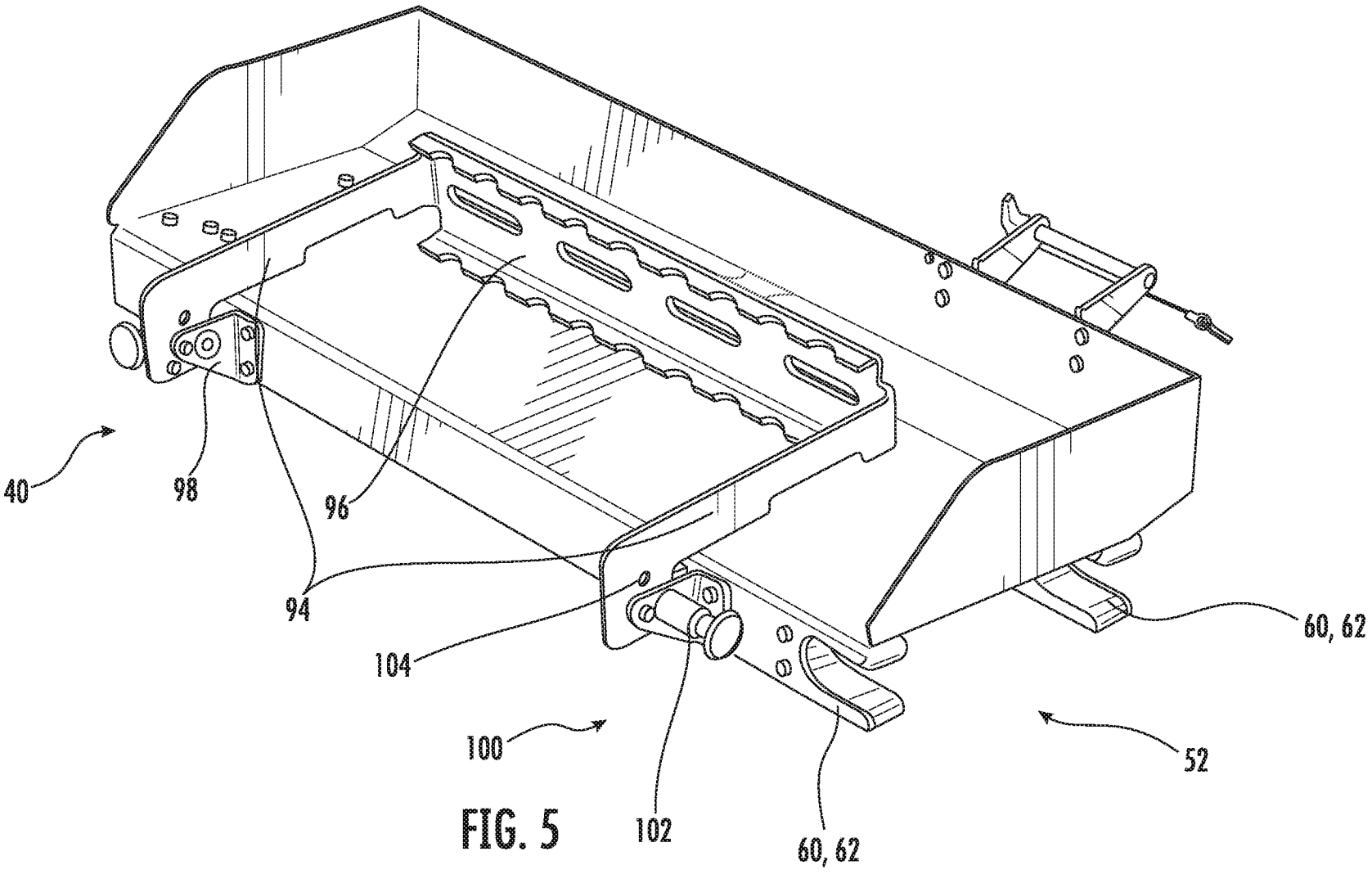
FIG. 5 is a front perspective view of the access deck assembly of FIG. 3 with the step in a folded position.
Figure 6:
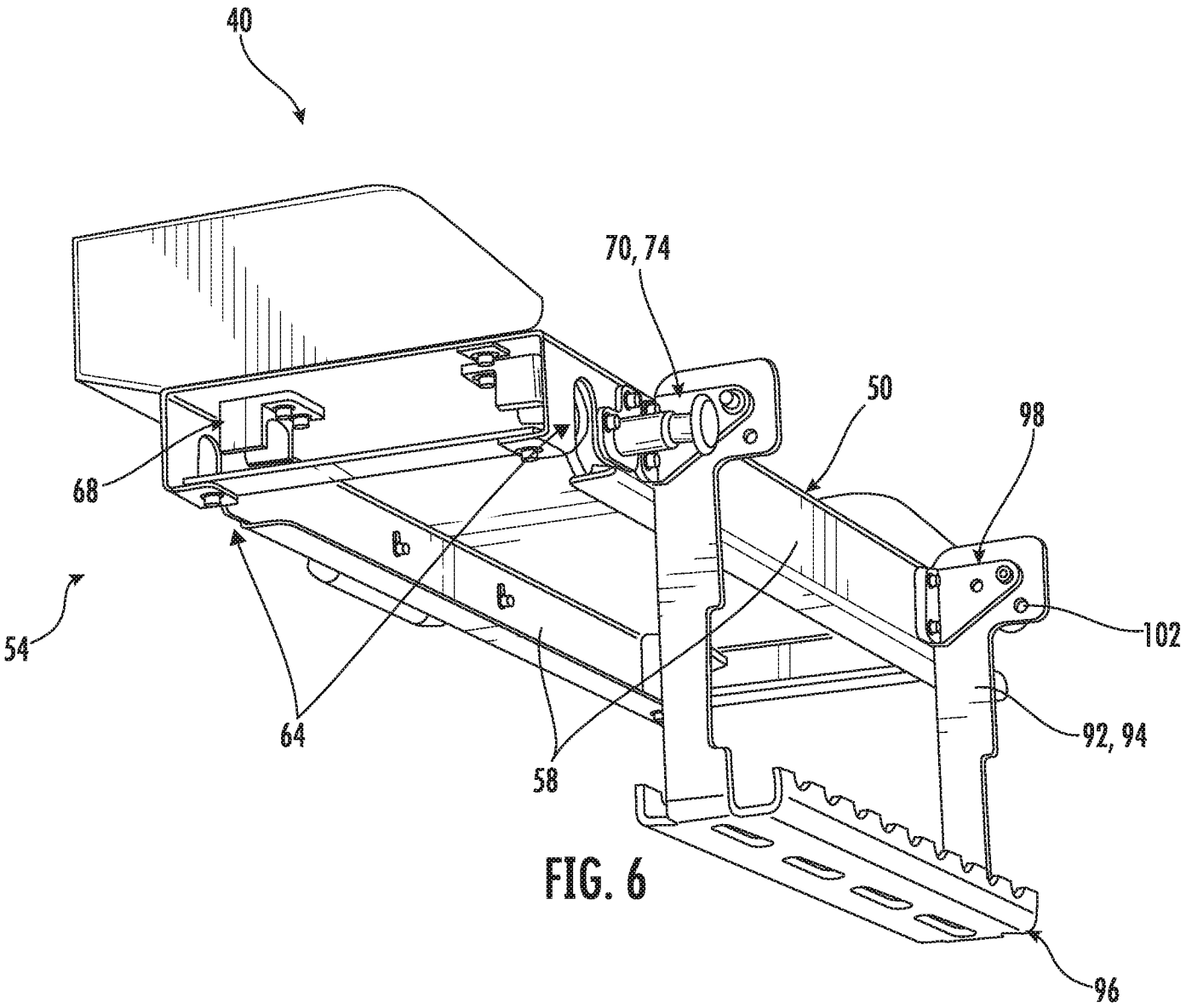
FIG. 6 is an alternative front perspective view of the access deck assembly of FIG. 3.

The access deck assembly 40 may be provided with a step 92. The step 92 may be moved between a first position or use position, as shown in FIG. 3, and a second position or storage position, as shown in FIG. 5. The step 92 has a pair of arms 94, and a tread member 96 extending between the arms 94. Each arm 94 may be pivotally connected to an associated mounting bracket 98 on the substrate 50. Each arm may additionally have a cutout edge allowing the arm to lie along the substrate upper surface when in the storage position. The operator may use the step 92 is moving between the platform 26 and the surface 56 of the base member 50.

A locking mechanism 100 may be provided to lock the step into the first or second position as selected by the operator. In one example, the locking mechanism 100 is provided by a spring-loaded pull pin mechanism 102 that is supported by one of the brackets 98. The arm 94 has first and second apertures 104, 106 that are configured to cooperate with the pin of the mechanism 102 and are positioned to locate the step 92 into each of the first and second positions.

Figure 4:
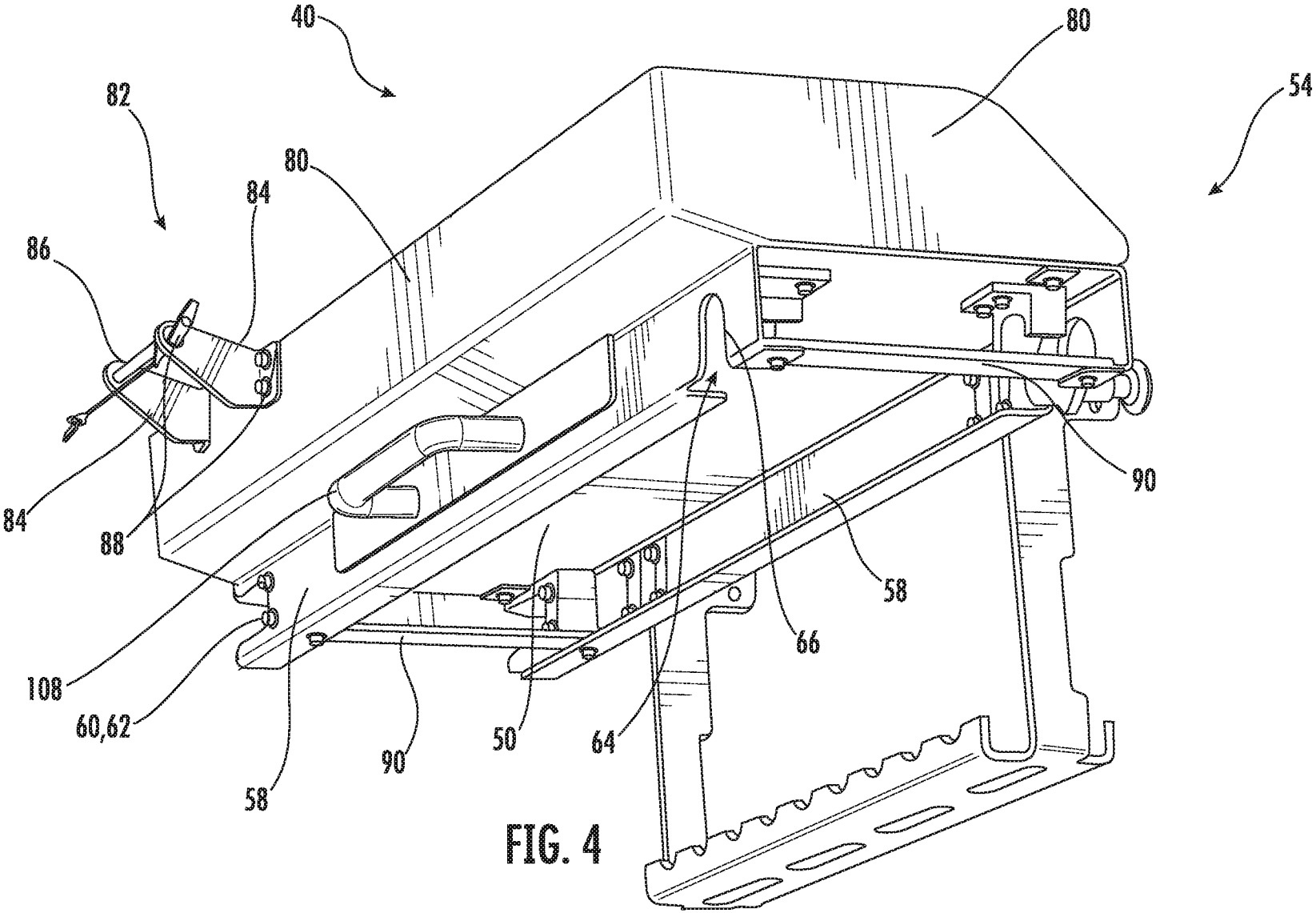
FIG. 4 is a rear perspective view of the access deck assembly of FIG. 3.

One of the sidewalls 58 may be offset from the edge of the base member 50 as shown in FIG. 4 to provide clearance for a handle 108. The handle 108 assists the operator in moving the access deck assembly when it is in a storage position.

In order to connect the access deck assembly to the mobile lift platform assembly 24, the operator positions the mid-perimeter rail into the channels of the hanger guides, and slides or translates the access deck assembly towards this mid-perimeter rail such that the rail is seated in the channel. The operator then lowers the second end of the base member down with the locking mechanism 70 in an open position until the mid-perimeter rail on the other side of the platform fits into the channels of the support guides. The mid-perimeter rail rotates the latch member 72 as it moves into the channel, and the pin 74 engages with the aperture in the latch 72 to engage the locking mechanism 70. A vertical frame member is then positioned between the arms of the anchor bracket 82, and the pin is connected to the arms to locate the access deck relative to the vertical frame member. The operator may then deploy the step from the storage position to the use position by using the locking mechanism 100. The above steps may be performed in a reverse order in order to disconnect the access deck assembly from the mobile work platform assembly.

FIGS. 8-11 illustrate a handle assembly 120 according to an embodiment. In various examples, the access deck assembly 40 may additionally include one or more handle assemblies 120, and the handle assembly 120 may be used with the aerial lift 20 of FIGS. 1-2 as handle 44. In the present example, a single handle assembly 120 is shown; however, two or more handle assemblies 120 are also contemplated for use with the lift 20 and/or access deck assembly 40.

The handle assembly 120 has a support bracket 122 that has first and second connection points 124, 126 to mount the support frame to the perimeter frame of the mobile work platform assembly 24. The connection points 124, 126 may be provided as U-bolts and associated nuts, or another fastener mechanism. One of the connection points 124 may be positioned about a vertical frame member while the other connection point 126 may be positioned about a horizontal frame member, such as the upper frame member. In other examples, the handle assembly may be permanently affixed to the platform 24 by welding the support frame to the frame.

Figure 8:
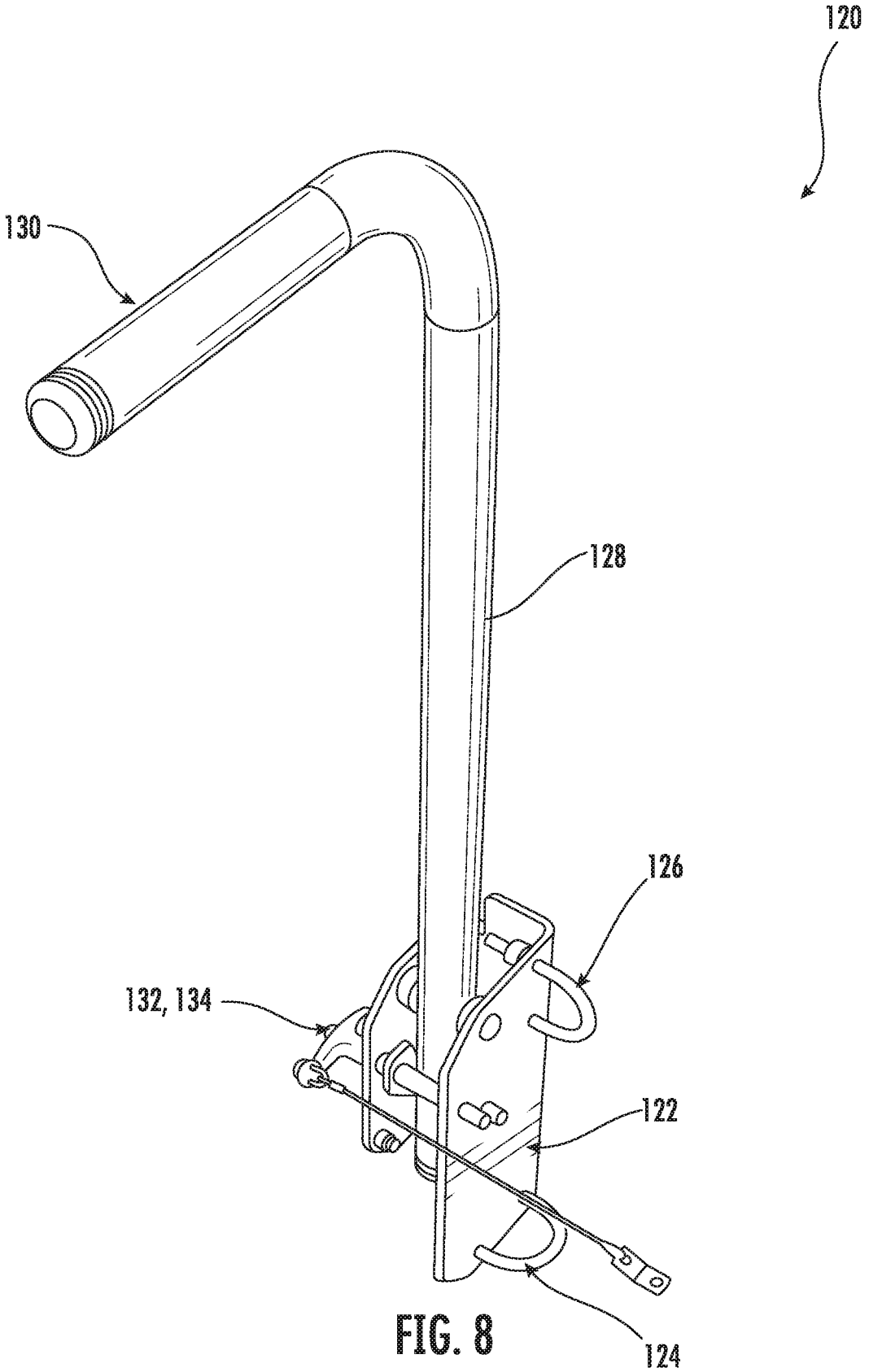
FIG. 8 is a front perspective view of an access deck handle assembly according to an embodiment, with the handle in a first position, and for use with the mobile work platform of FIGS. 1 and 2 and the access deck assembly of FIG. 3.
Figure 9:
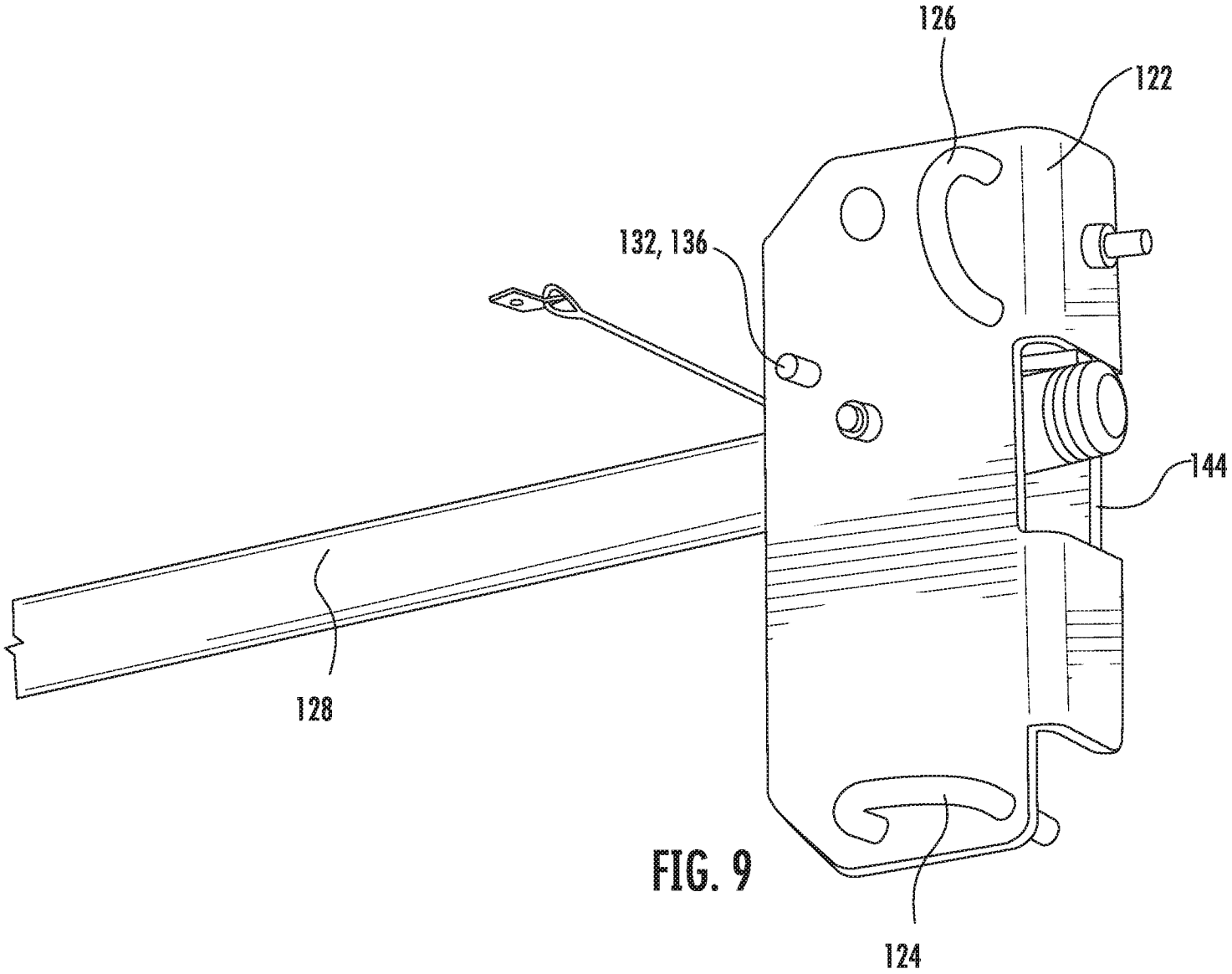
FIG. 9 is a partial rear perspective view of the access deck handle assembly of FIG. 8. with the handle in a second position.
Figure 11:
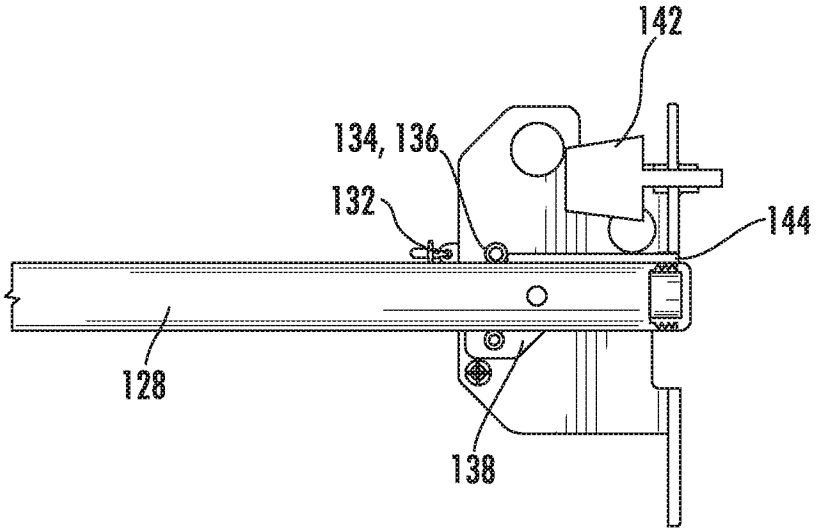
FIG. 11 is a partial sectional view of the access deck handle assembly of FIG. 8 with the handle in the second position.
Figure 10:
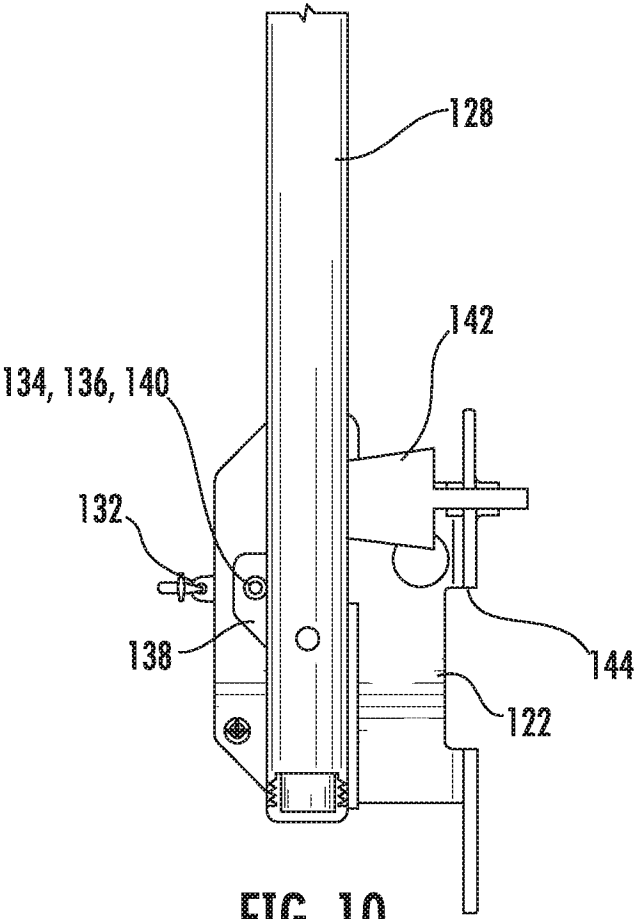
FIG. 10 is a partial sectional view of the access deck handle assembly of FIG. 8 with the handle in the first position.

A handle 128 is rotatably connected to the support bracket 122, for example via a pivotal connection. The handle is movable between a storage position and a use position. The use position is shown in FIGS. 8 and 10. The storage position is shown in FIGS. 9 and 11. A distal end of the handle 128 may be provided with a grip bar 130, and additionally may be provided with a texture and/or a coating for the operator.

A locking mechanism 132 may be provided to retain the handle in the use position, and to retain the handle 128 in the storage position. According to one example, the locking mechanism 132 has a locking pin 134, for example, a quick release ball locking pin, a pin with a folding latch end, a wire lock pin provided by a clevis pin with an attached wire loop, or another locking member. The locking pin may be connected to the support frame via a leash. With the locking mechanism in an engaged position, and with the handle 128 in the use position, the locking pin extends through apertures 136 defined in the support bracket 122, as well as through apertures 140 defines through a swinging bracket 138. The swinging bracket 138 is permanently affixed to the proximal end of the handle 128 and moves with the handle 128.

A bumper element 142 may be provided and is connected to the support bracket 122. The bumper element 142 contacts the handle 128 with the handle 128 in the use position to prevent noise and rattle of the handle 128. The bumper element 142 may be formed from a resilient material such as a rubber.

A cutout region 144 is formed in the support bracket. With the handle in the storage position, the proximal end of the handle and the associated swinging bracket contact the upper edge of the cutout region 144, as shown in FIGS. 9 and 11, to provide a stop or limit to the rotational movement of the handle 128. The locking pin 134 may be inserted through the apertures 136 formed in the support bracket 122 to retain the handle 128 in the storage position and prevent rotation towards the use position, as shown in FIG. 11.

Figure 12:
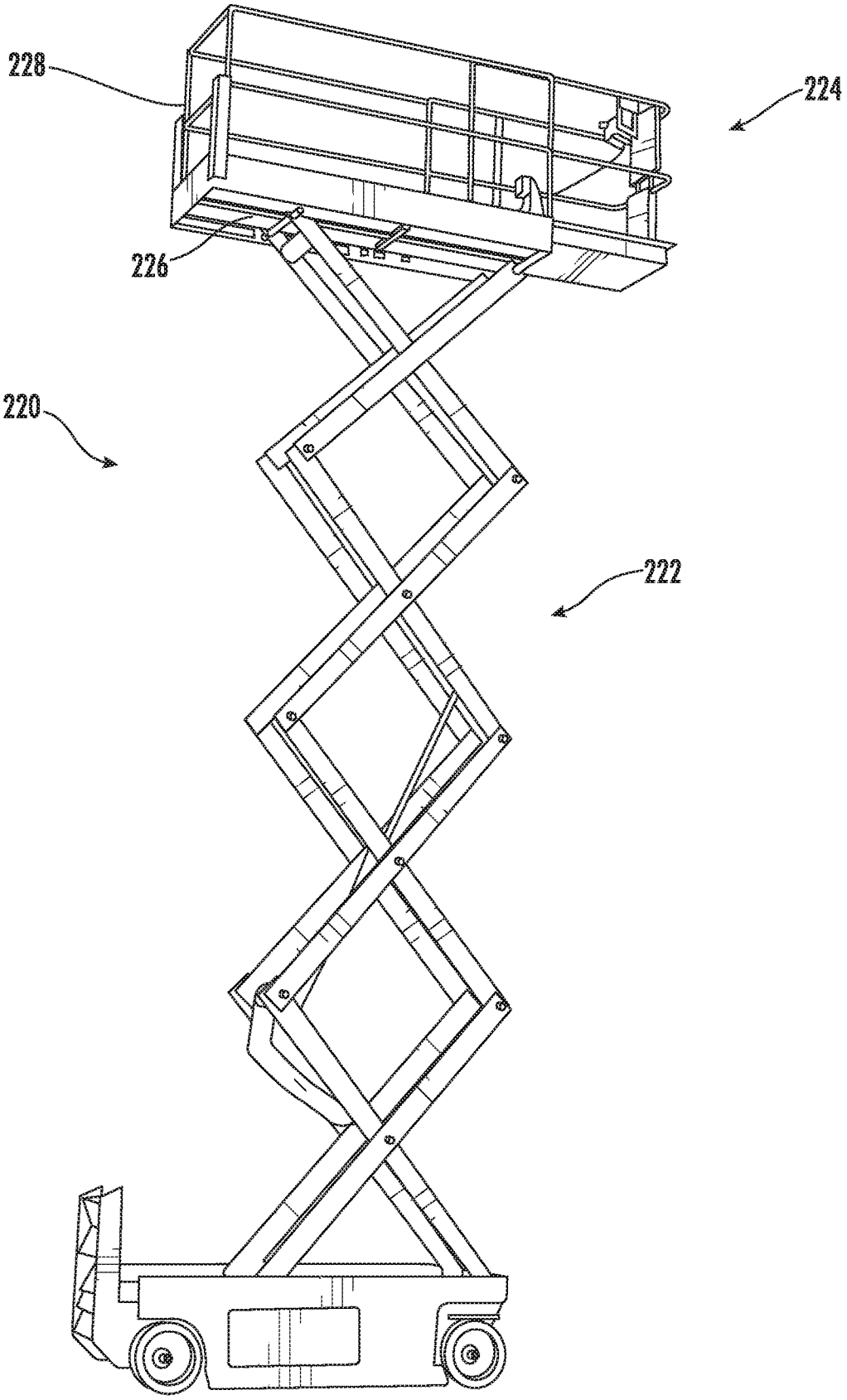
FIG. 12 illustrates a perspective view of an aerial lift platform according to an embodiment and configured to implement the present disclosure.

FIG. 12 illustrates a land vehicle according to another embodiment and depicted as a scissor lift 220. The aerial lift 220 is mobile and includes a scissor lift mechanism 222 for transporting and lifting a mobile work platform assembly 224, often referred to as a basket. The scissor lift 220 may be another utility vehicle with a mobile work platform assembly such as an aerial lift, aerial work platform, a rough terrain telescopic load handler, portable material lift, telehandler, telescopic and articulating boom, and the like. In other examples, the vehicle 220 may be provided as vehicle 20 described above with respect to FIG. 1. The vehicle 220 is configured for lifting a load, such as a person, tools, cargo, and the like, with respect to an underlying support surface, such as paved or unpaved ground, a road, an apron such as a sidewalk or parking lot, an interior or exterior floor of a structure, or other surfaces. Traction devices, such as wheels, support the vehicle on the underlying surface.

Figure 13:
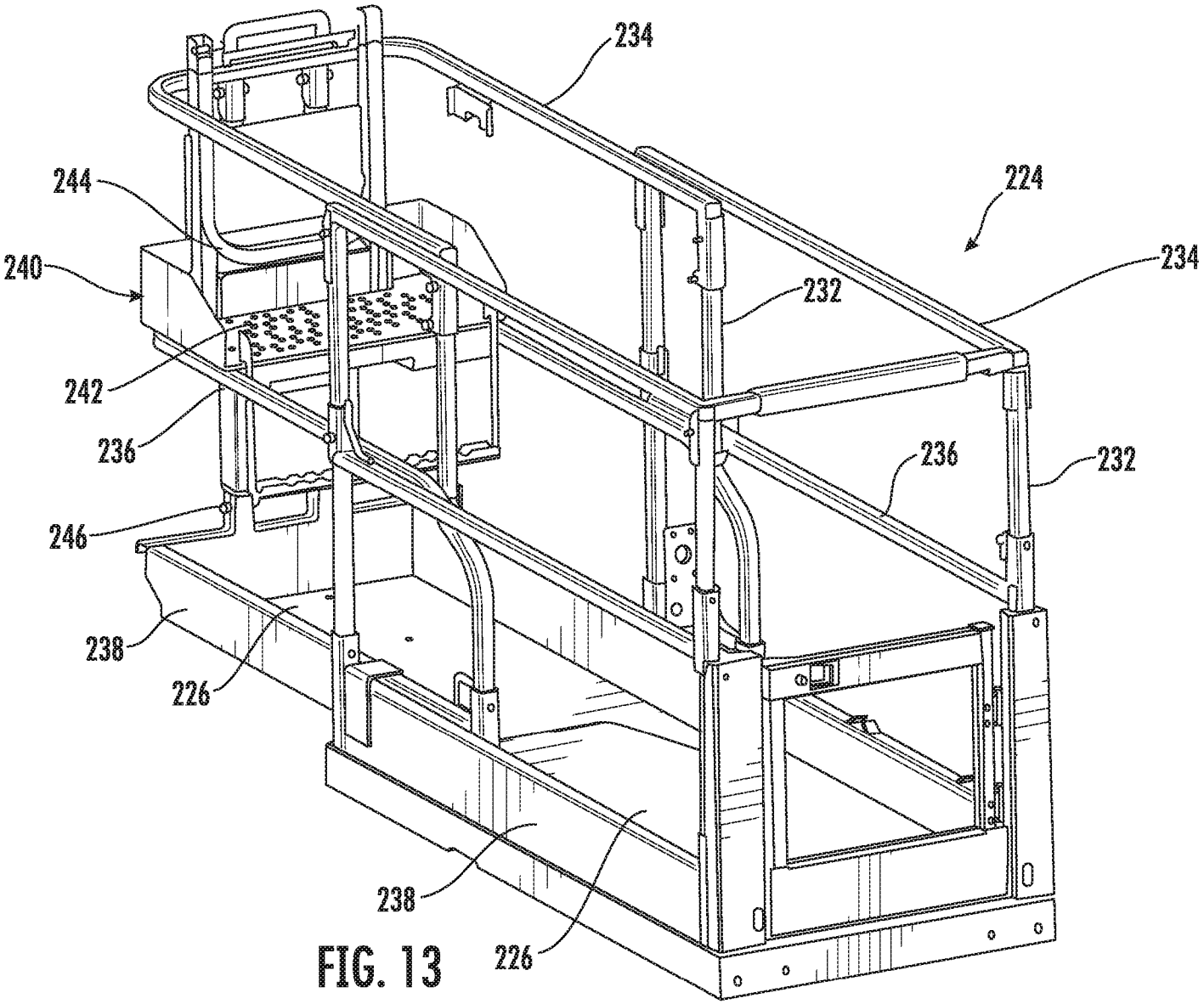
FIG. 13 illustrates a perspective view of a platform of the aerial lift platform of FIG. 12 with an access deck according to an embodiment installed with a handle assembly in a first position.

The mobile work platform assembly 224 of FIG. 12 is illustrated in greater detail in FIGS. 13-16. With reference to FIGS. 12-15, the mobile work platform assembly 224 includes a platform 226 sized to receive one or more operators or users upon the platform 226, e.g. as a floor of the assembly 224. A perimeter frame assembly 228 is provided upon the platform 226. The frame assembly 228 provides a frame of guard rails that extend around a perimeter of the platform 226 to contain an operator within the frame assembly 228. A door is provided upon the frame assembly 228 to permit operator ingress to, and egress from, the frame assembly 228. The mobile work platform assembly 224 may include a single floor and associated frame assembly 228. Alternatively, the assembly 224 may include multiple platforms or floors each with an associated frame assembly 228 that cooperate with one another to provide a floor and a frame assembly for the entire mobile work platform. An example of a platform assembly 224 with multiple floors is shown in FIG. 13 with a secondary, movable extension deck that is connected to the main deck.

The frame assembly 228 includes a series of vertical support members 232 with an upper rail 234 extending about an outer perimeter of the platform 226. The frame assembly 228 additionally has an intermediate rail 236, or mid-perimeter rail, positioned between the upper rail 234 and the platform 226 and extending about an outer perimeter of the platform 226. A lower guard 238 or toe guard 238 may additionally be provided on the mobile work platform assembly 224 as shown. The frame assembly 228 provides a railing for an operator in the mobile work platform assembly 224. According to one embodiment, the frame assembly 228 includes rails with a square cross-sectional shape, e.g. formed from square tubing.

Figure 14:
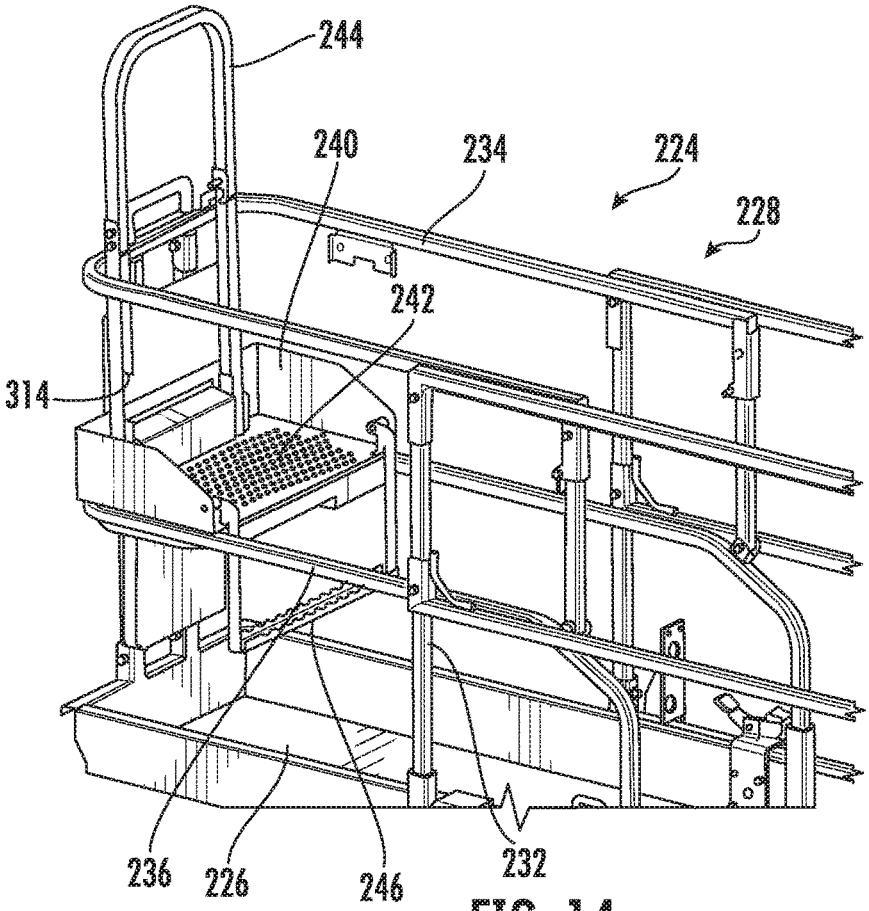
FIG. 14 illustrates a partial perspective view of the platform and the access deck of FIG. 13 with the handle assembly in a second position.
Figure 15:
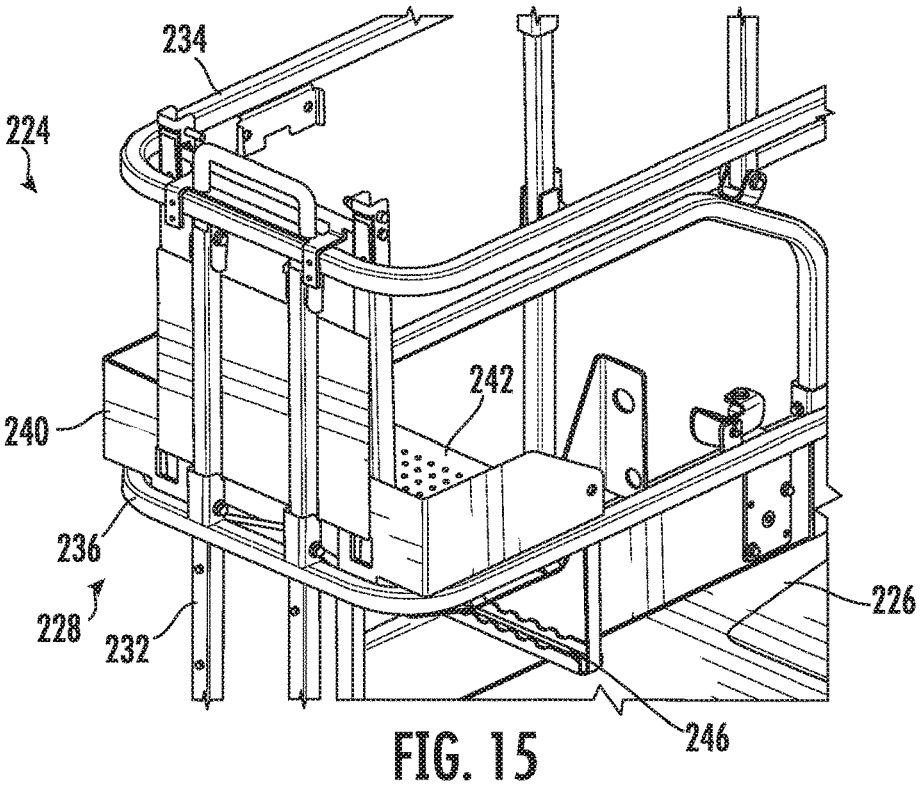
FIG. 15 illustrates another partial perspective view of the platform and access deck of FIG. 13 with the handle assembly in the first position.

A scissor lift 220 is commonly used for translating and lifting an operator to an otherwise, difficult to reach work location. Such work locations are often elevated above ground and may require special access beyond that available to an operator standing on the platform 226. In order for an operator to work in a special access condition, the operator may need to be elevated above a position available when standing on the platform 226 surface. For example, the mobile work platform assembly 224 may be raised to a point where there is no additional clearance to raise the platform, or until a maximum vertical travel of the assembly 224 has been reached. An access deck assembly 240 is provided for use with the aerial lift 220 for providing a raised surface relative to the platform 226 for the operator to stand on or otherwise use when the operator needs to be at a position above that allowed by the platform 226 surface. An embodiment of an access deck assembly is shown in FIGS. 13-15. The access deck assembly 240 is connected to and fixed relative to the assembly 224 to provide a stable and secure work surface for the operator. Conventionally, an operator has used a stepstool placed onto and not connected to the assembly 224 or has stood directly on a member of the frame 228, which does not provide a stable or secure position for the operator on the aerial lift 220.

The access deck assembly 240 is provided on the interior of frame assembly 228. The access deck assembly 240 is detachably connected and secured to the frame assembly 228 and the mobile work platform assembly 224, such that it is movable to different locations within the platform assembly 224, or may be completely removed at certain times for storage. As shown in FIGS. 13-15, the access deck assembly 240 includes an access platform 242 mounted to the interior of frame assembly 228 and raised relative to the platform 226 surface for an operator to stand upon for a special access condition.

The access deck assembly additionally includes a support handle assembly 244 that is connected to the access platform 242. The support handle 244 provides a three-point balance support or grasping point for the operator when the operator is entering, leaving, or otherwise using the access deck assembly 240. The support handle assembly may be movable between three positions: (i) a use position with the handle extended for grasping by a user on the access platform as shown in FIG. 14, (ii) a stowed position with the handle positioned below the upper rail to reduce the overall height of the scissor lift and provide additional clearance, e.g. to move the scissor lift through a door, as shown in FIGS. 13 and 15, and (iii) a folded position with the handle assembly adjacent to the standing surface of the access deck platform, e.g. for use when transporting or storing the access deck assembly, as shown in FIG. 16.

Figure 16:
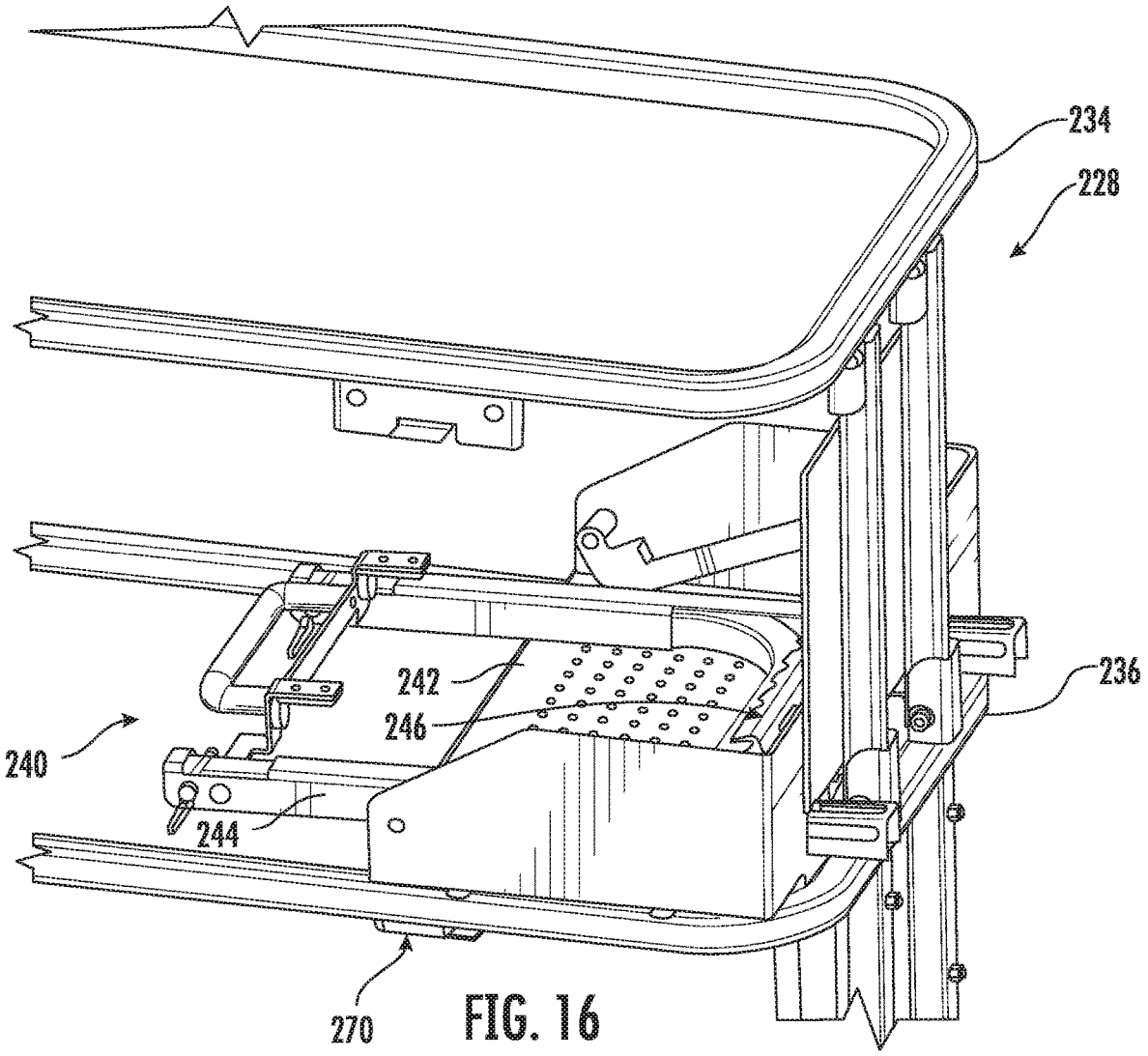
FIG. 16 illustrates another partial perspective view of the platform and the access deck of FIG. 13 with the handle assembly in a third position.

The access deck assembly 240 additionally includes a step 246 that is movable between a use position as shown in FIGS. 13-15 and a stowed position for use when transporting or storing the access deck assembly, as shown in FIG. 16. The step 246 may be used by an operator when moving from the platform 226 to the platform 242 of the access deck assembly 240.

The access deck assembly 240 extends across the platform assembly, e.g. between frame members on opposite sides of the platform. Although one length of the access deck assembly 240 is illustrated, any suitable access deck length is contemplated, and the length of the access deck assembly 240 may be selected based on the size of the platform assembly 224. Although one access deck assembly 240 is illustrated, multiple access deck assemblies 240 may be utilized, e.g. to provide multiple special access points for more than one operator, or to provide one operator with multiple special access points to move between during a job.

FIGS. 17-22 illustrate perspective views of the access deck assembly 240 in various configurations. In various embodiments, the access deck assembly 240 may be used with the aerial lift 220 and mobile work platform assembly 224 of FIGS. 12-16, and in other examples, may be used with the vehicle 20 as described above. For convenience, elements that are the same or similar to those shown in FIGS. 12-16 are given the same reference number. The access deck assembly 240 is detachably connected and secured to the frame 228 of the mobile work platform assembly 224 to prevent movement of the access deck assembly 240 relative to the mobile work platform 224. The access deck assembly 40 may be easily disconnected from the frame 228 by the operator to move the access deck assembly 240 to another location, or for storage of the access deck assembly 240.

The access deck assembly 240 includes a base member 250 or substrate 520. In one example, the base member 250 may be formed or welded from suitable strength materials, such as aluminum alloys. In other examples, the base member 250 may be formed from another material.

The base member 250 is sized to have a length to extend across the mobile work platform 224. A first end 252 of the base member cooperates with the mid-perimeter rail 236 on one side of the mobile work platform, while the second, opposite end 254 of the base member cooperates with the mid-perimeter rail 236 on the other side of the mobile work platform.

The base member has an upper surface 256 and a lower surface opposite to the upper surface. The upper surface 256 may have a tread pattern formed therein or may have an anti-skid coating.

A guide 260 is provided on the first end of the base member 250. In the present example, the guide 260 is connected to the base member 250. The guide 260 forms a channel that is sized to receive a portion of the mid-perimeter rail. The guide 260 extends transversely along the base member. The guide 620 is connected to the base member at an offset distance from the end 254 of the base member, and is connected at to the base member 250 at first and second ends 262, 264 of the guide. The guide 260 is also connected to the base member 250 via a bracket 266 that is located at an intermediate location along the guide 260. The guide 260 may extend towards the end 254 of the substrate in an intermediate location such that the edge of the guide 260 in the intermediate location is co-planar with the end 254 of the base member 250. A generally U-shaped channel is thereby formed by the base member 250, the guide 260, and the bracket 266 such that the mid-perimeter rail 236 is received therein as is shown in FIG. 14. The varying width or offset of the guide 260 forms the channel and provides clearance for the mid-perimeter rail. The base member 250, the bracket 266, and the guide 260 may each have resilient elements 268 or damping elements 268, such as felt pads, rubber bumpers, or the like.

A locking mechanism 270 is provided at the other end 252 of the base member 250. In other examples, more than one locking mechanism may be provided. The locking mechanism 270 has a latch member 272 that is supported for sliding motion or translation within a bracket 274 in the base member 250. An aperture is formed through the bracket 274 for an operator to access an end of the latch member 272. A biasing member such as a spring element is positioned within the bracket 274 to bias the latch member 272 towards the end 252 of the base member 250. When sufficient force is applied by an operator to the end of the latch member 272 to overcome the biasing force of the spring element, the latch member 272 slides away from the end 252 to disengage from a mid-perimeter rail. The latch member 272 may be provided with an inclined face 278 such that, when connecting the access deck to the rail, the force on the latch member 272 from the mid-perimeter rail is applied to the spring element and overcomes the biasing force of the spring element to move the latch member 272 away from the first end 252 of the base member and open the locking mechanism. When the mid-perimeter rail has cleared the latch member 272 and is generally in contact with guide 280, the spring member will bias the latch member towards the end 252, thereby engaging the locking mechanism 270 without an external input from an operator. In other embodiments, other locking mechanisms may be used with the access deck assembly to retain the access deck assembly to the platform. The base member 250 may have resilient element 282 or damping elements 282, such as felt pads, rubber bumpers, or the like. The guide 280 may be provided with a locating feature, such as a face extending transversely to the base member 250, to limit movement of the access deck assembly 240 relative to the rails along a longitudinal direction of the access deck assembly.

The access deck assembly 240 includes a toe guard 290 extending around at least a portion of the perimeter of the base member 250. In one example, and as shown, the toe guard 290 extends around three sides of the base member 250, and is connected or fastened to the base member 250.

Figure 17:
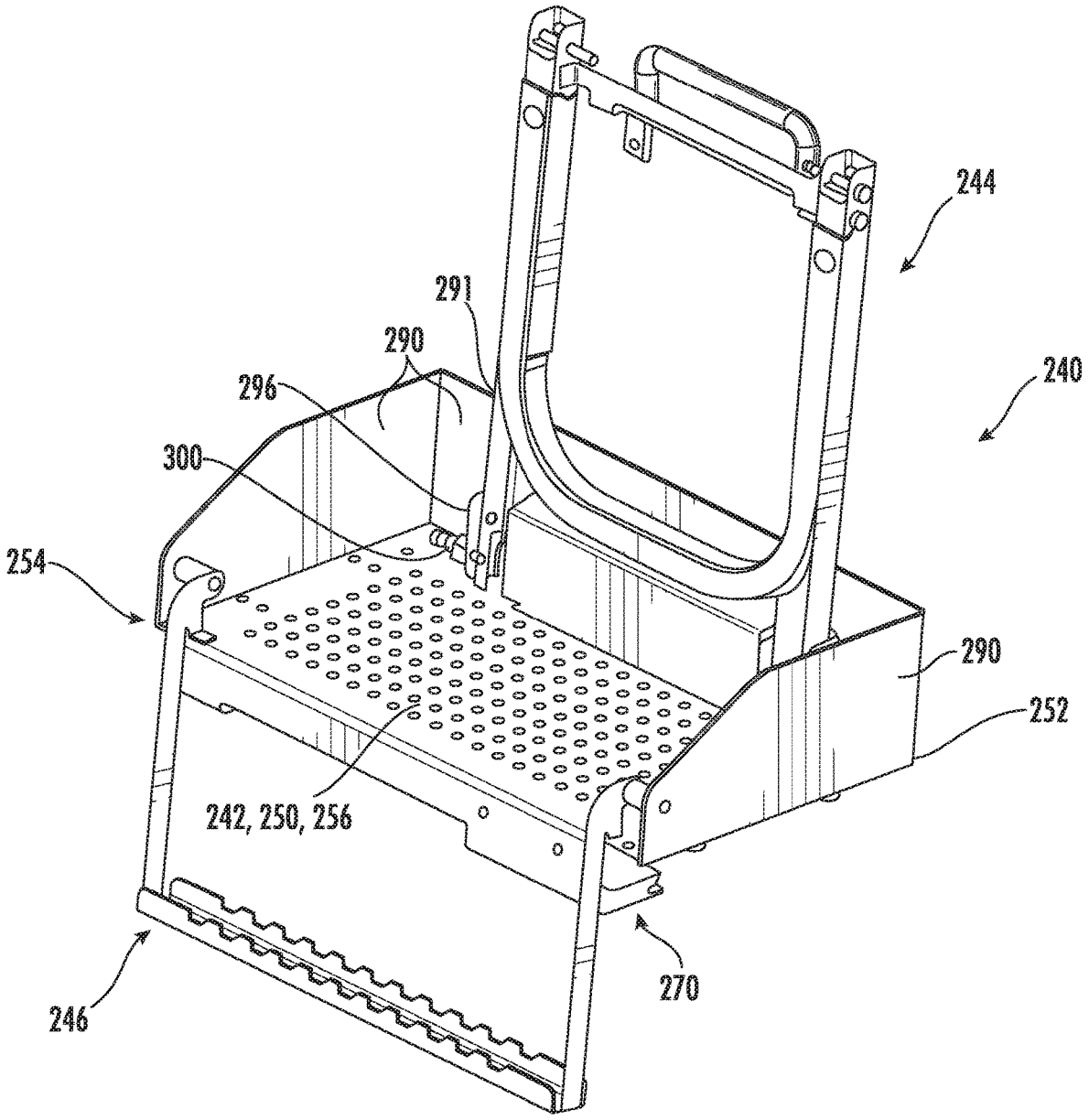
FIG. 17 is a perspective view of an access deck assembly for use with the aerial lift of FIG. 12.

A handle assembly 244 is rotatably connected to the base member 250. The handle assembly has first and second legs 291. Each leg has a slot 292 in an end region 294. The base member 250 has a bracket 296 associated with each leg 291. A pin 298 is connected to the bracket 296 and extends through the slot 292 of the leg 291. A locking pin 300, such as a pull pin, may be used to retain the handle assembly with the legs in the upright position as shown in FIG. 17. The locking pin 300 may be connected to the bracket, with the leg 291 having apertures to engage with the pull pin.

Figure 18:
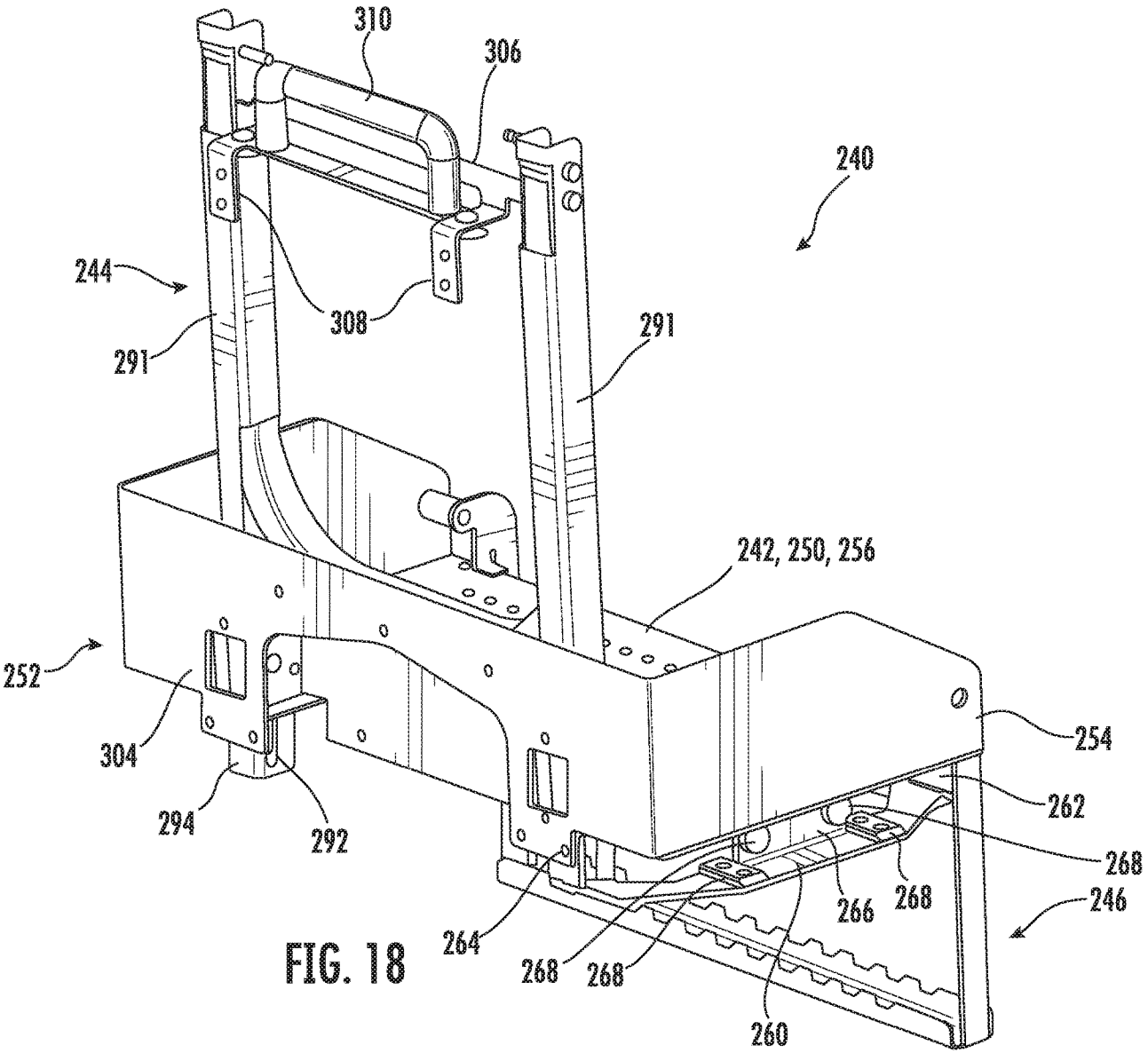
FIG. 18 is another perspective view of the access deck assembly of FIG. 17.
Figure 19:
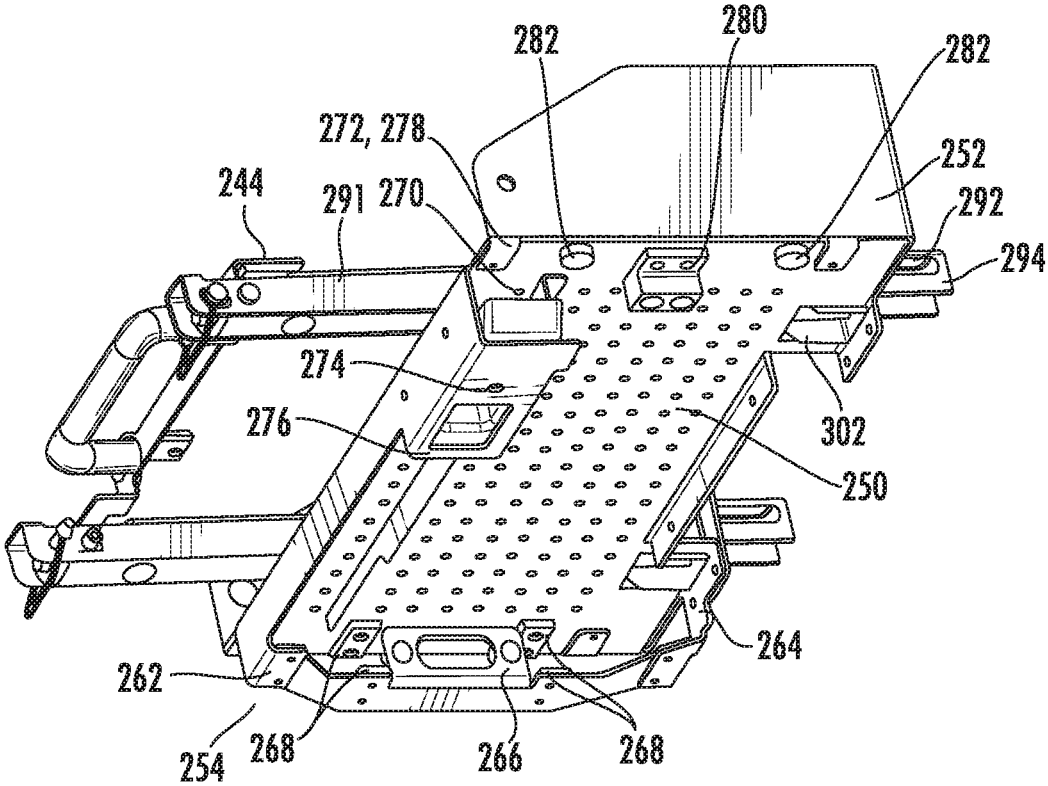
FIG. 19 is yet another perspective view of the access deck assembly of FIG. 17 with the handle assembly and the step placed in storage positions.
Figure 20:
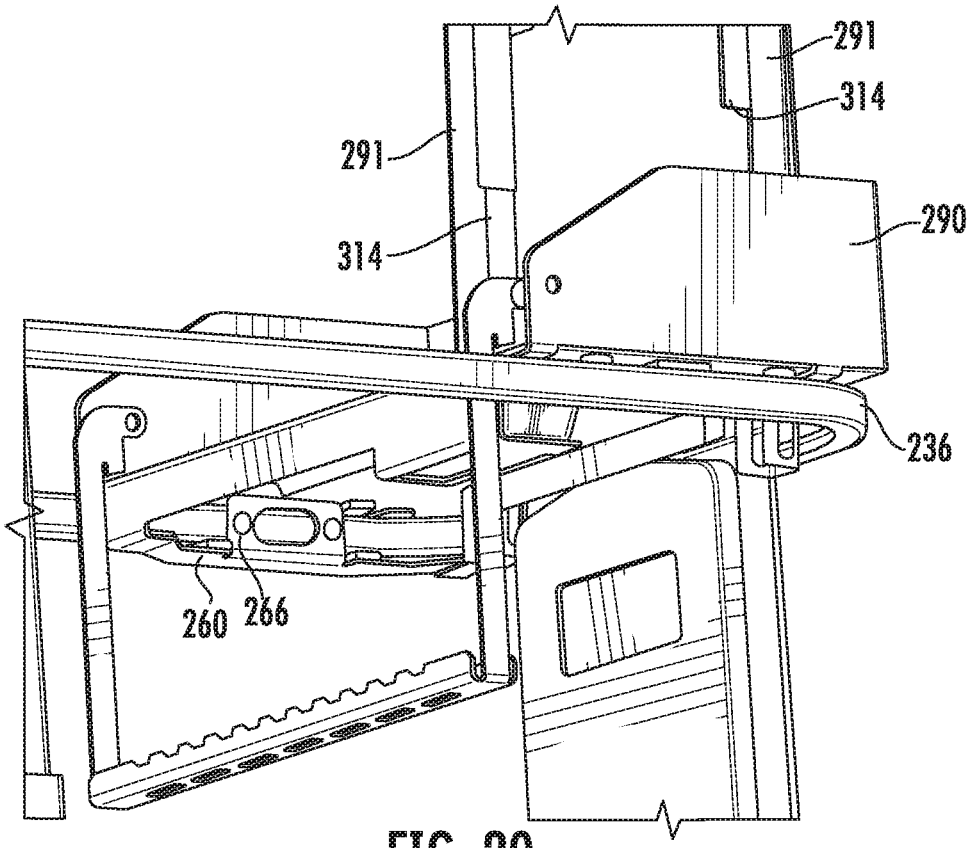
FIG. 20 is a partial perspective view of the aerial lift platform and the access deck assembly of FIG. 17.

For each leg 291, there is a first aperture 302 in the base member 250 and a second aperture 304 in the toe guard 290. When the handle assembly is in a folded position, as shown in FIGS. 16 and 19, the legs 291 extend through the apertures 304. To move the handle assembly 244 to an upright position, as shown in FIGS. 17 and 18, the pull pin 300 is moved to release the handle assembly from the folded position. The handle assembly 244 is translated, e.g. the pin 298 is translated with the slots, until the end regions of the legs 291 are clear of the apertures 304. The handle assembly 244 is then rotated towards an upright position. When the handle assembly 244 is upright, it is then translated in a downward direction such that the end regions of the legs 291 extend through their respective apertures 302. The pull pin 300 may then be engaged with an associated aperture in the handle assembly 244 to locate it relative to the base member 250.

A handle cross-member 306 may extend between the legs 291. The cross-member 306 may be provided with one or more hanging brackets 308, and two hanging brackets 308 are illustrated. The hanging brackets 308 are shaped to cooperate with the upper perimeter rail 234 as shown in FIG. 15, and may be provided with bumper pads on interior surfaces to reduce vibration and rattle. A carrying handle 310 may additionally be provided on the cross-member 306. The carrying handle 310 may be used to carry the access deck assembly 240 when it is in a folded position, for example, for transporting or storing the access deck assembly 240.

Figure 21:
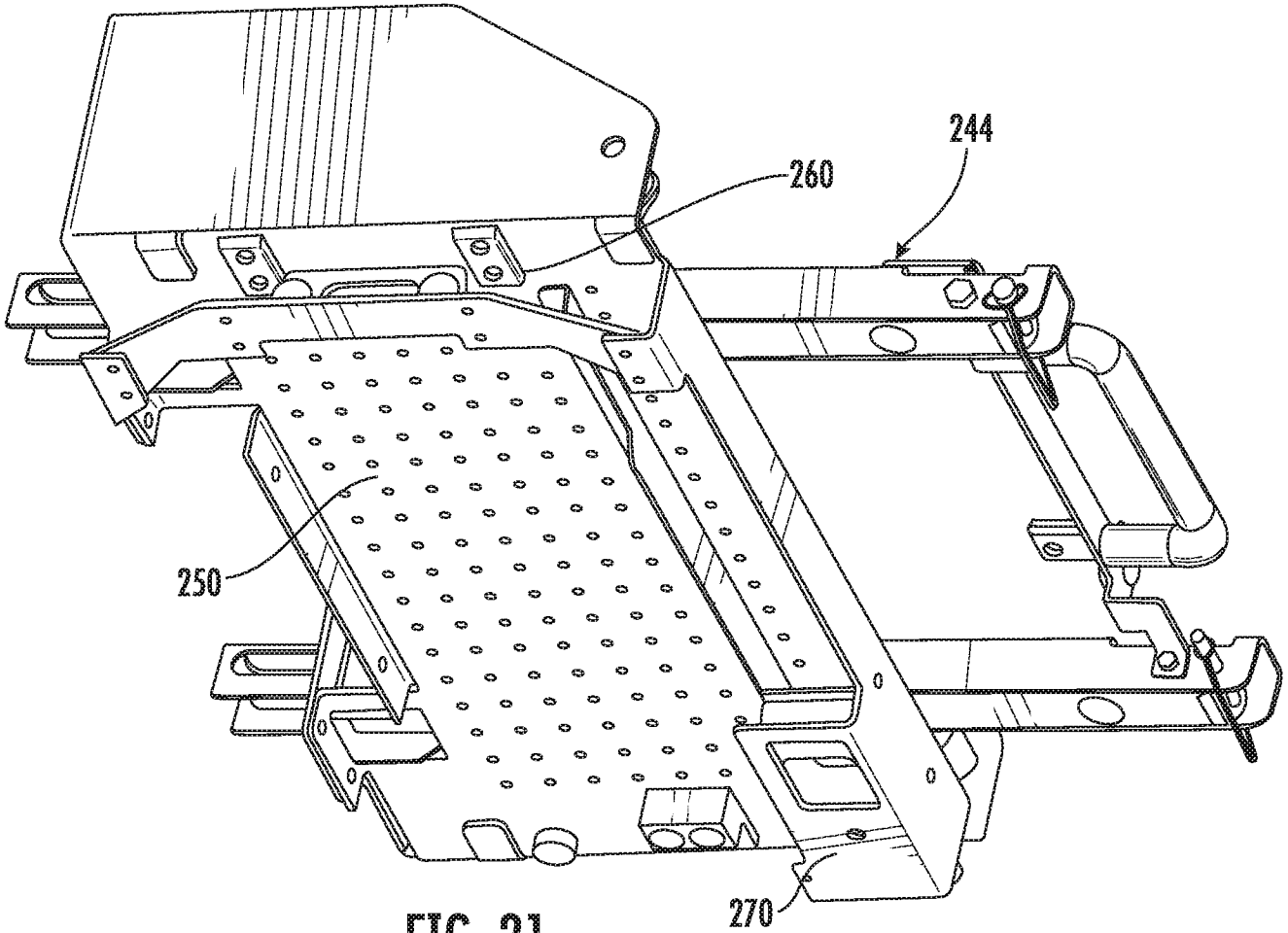
FIG. 21 is a perspective view of the access deck assembly of FIG. 17 with the handle assembly and the step placed in storage positions.
Figure 22:
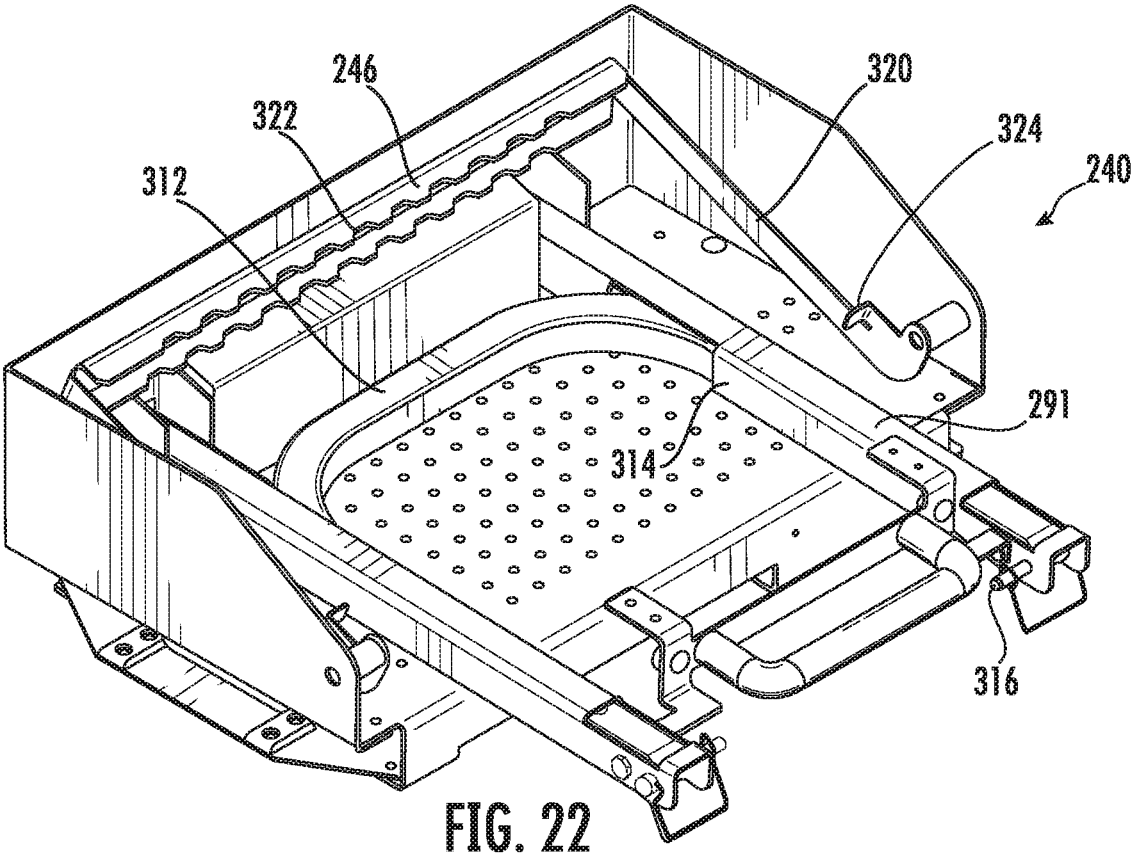
FIG. 22 is another perspective view of the access deck assembly of FIG. 17 with the handle assembly and the step placed in storage positions.

The legs 291 may each be provided with an open channel shape. An upper handle 312 is rotatably connected to the legs 291, and fits within the channels formed by the legs 291. The upper handle 312 may be folded and stored within the legs 291, for example, to provide clearance when the aerial lift is passing through a doorway or another low clearance location, as is shown in FIG. 17. The upper handle 312 may be rotated upwards to a use position as is shown in FIG. 14, to provide a holding location or grasping point for an operator standing on the access deck assembly 240. The legs 291 may define openings 314 in sidewalls of the channel shapes to provide clearance for the upper handle assembly 312 in the storage position. A pin 316, such as a pull pin or other locking member may cooperate with the legs 291 and the upper handle 312 to retain the upper handle 312 in the use position. In further examples, the pin 316 may additionally be used to retain the upper handle 312 in the storage position as shown in FIGS. 21-22.

A step 246 is rotatably connected to the base member, for example at the toe guard 290. The step 246 rotates from a first, use position as is shown in FIG. 17 to a second, storage position as is shown in FIG. 22. In one example, and as shown, the step 246 does not have an associated locking mechanism to retain its position. In a further example, bushings may be used in the pivotal connection to provide resistance to movement of the step 246, and may be formed from a nylon or other material. In alternative examples, a locking mechanism may alternatively be provided for use with the step 246. The step 246 has a pair of arms 320, and a tread member 322 extending between the arms 320 as shown in FIG. 22. Each arm 320 may additionally have a flange 324 that cooperates with the upper surface of the base member 250 when the step is in the unfolded, use position. The operator may use the step 246 when moving between the platform 226 and the platform 242 of the access deck assembly 240.

When the access deck assembly 240 is installed onto the perimeter frame, the guide 260, the guide 280, and the locking mechanism 270 prevent the access deck from moving in a vertical direction and prevent translational movement along a first axis, such as the longitudinal axis of the access deck. The hanging brackets 308 of the handle assembly 244 prevent translational movement of the access deck assembly along a second axis, such as the transverse axis of the access deck. The access deck is therefore connected to the mobile work platform and has zero degrees of freedom. The first, second, and third (vertical) axis may be orthogonal to one another.

In order to connect the access deck assembly to the mobile lift platform assembly 224, the operator positions the access deck assembly 240 with the mid-perimeter rail into the channel formed between the base member and the guide 260, and slides or translates the access deck assembly towards this mid-perimeter rail such that the rail is seated in the channel. The operator then lowers the second end of the base member down until the mid-perimeter rail on the other side of the platform engages and moves the latch member of the locking mechanism. When the second end of the base member is lowered past the latch member, the spring element engages the latch member and locks the base member to the rail. The step 246 may then be unfolded to a use position. The handle assembly is then moved as described above from a storage position to an upright folded position with the hanger guides over the upper perimeter rail, and the handle assembly is locking into position using the pull pin 300. The upper handle assembly may then be unfolded and placed into a use position for grasping with the locking mechanisms 316 retaining the upper handle assembly in its position.

The above steps may be performed in a reverse order in order to disconnect the access deck assembly from the mobile work platform assembly. In order for the base member 250 to be removed from the rail, the operator manually operates the locking mechanism 270 to release the latch member.

FIGS. 23-26 illustrate perspective views of access deck assemblies for use with a platform of an aerial lift vehicle according to other examples of the disclosure, such as the vehicle 20 or vehicle 220. Elements in FIGS. 23-26 that are the same or similar to those used above in FIGS. 12-22 have the same reference numbers for simplicity.

Figure 23:
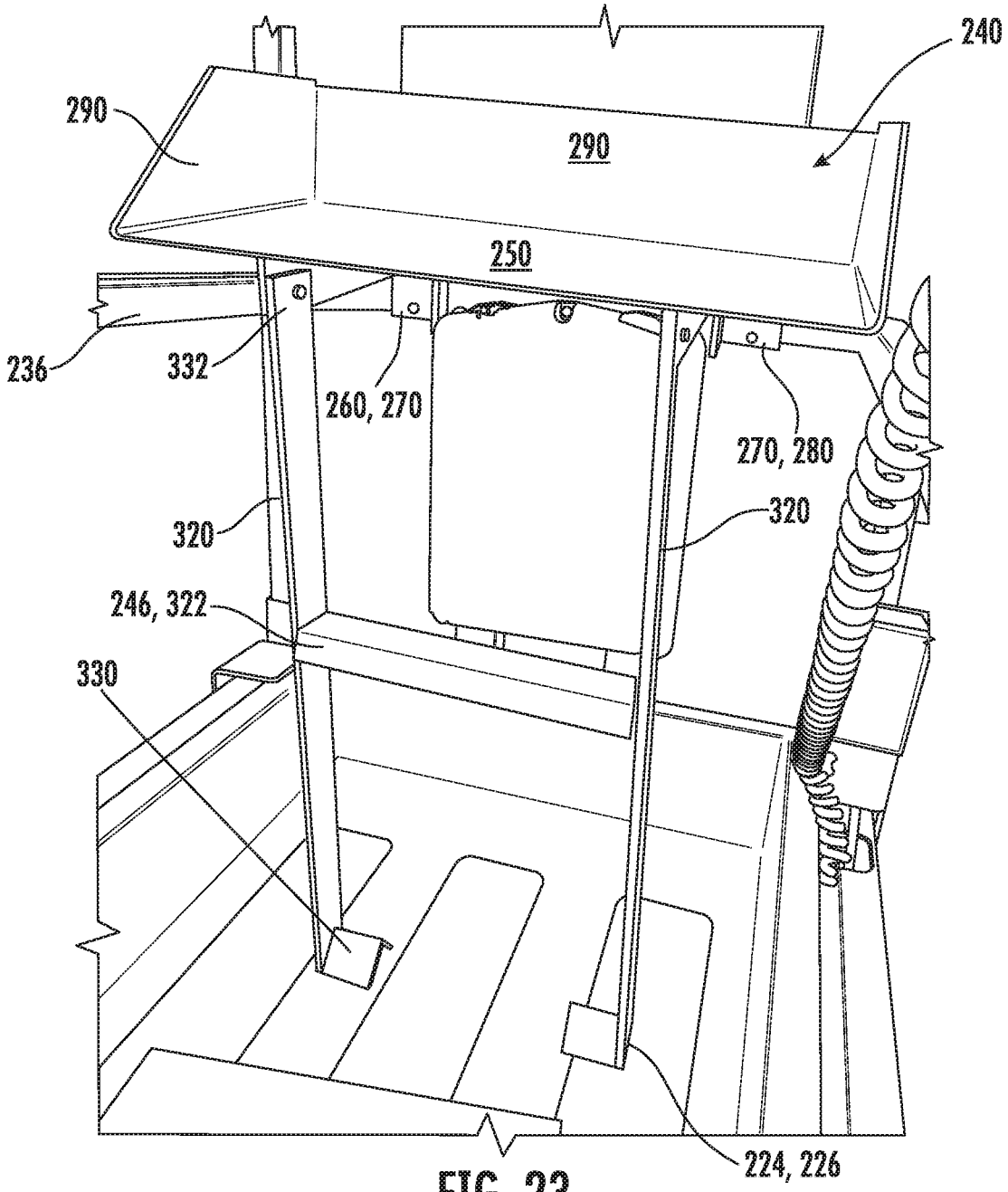
FIG. 23 is a partial perspective view of the aerial lift platform of FIG. 12 with an access deck according to another embodiment.

FIG. 23 illustrates an access deck assembly 240 connected to a mobile platform assembly 224. The base member 250 provides a surface for an operator to stand on that is elevated relative to and spaced apart from the floor surface 226 of the aerial platform. The base member 250 may be provided with a toe guard 290 as shown. A handle assembly may additionally be provided as described above, or as a separate attachment.

The access deck assembly 240 has first and second guides 260, 280 that are connected to or supported by the base member 250. The first and second guides 260, 280 are spaced apart from one another, and may be adjacent to first and second opposite ends of the base member 250 as shown. Each of the guides 260, 280 is configured to cooperate with and connect to a respective portion of the mobile platform assembly. In the example shown, the guides 260, 280 are connected to the mid-perimeter rail 236 of the platform assembly 224, and are positioned along a rear edge of the base member. In other examples, the guides 260, 280 may include brackets that extend vertically and/or horizontally from the base member 250 to the guides to connect the access deck assembly to another structure of the mobile platform assembly, such as the upper rail, the toe guard, or the floor surface.

Each of the guides may be provided as a channel or other shape sized to receive the rail 236. Locking mechanisms 270 are provided to connect the guides to the rail. The locking mechanisms 270 may include a latch or other releasable member. Alternative, the locking mechanisms 270 may be provided by fasteners, such as a bolted connection. In further examples, the locking mechanisms 270 may be provided by a permanent weld to the platform assembly.

The access deck assembly 240 has a step 246. The step 246 is connected to the base member 250, for example, along a front edge of the base member. In the example shown, the step has first and second legs 320 and a tread member 322 extending between the legs 320. Each of the legs 320 is provided with a foot 330 that contacts the floor surface 226 of the mobile platform assembly 226. The legs may be rotatably connected to the base member as shown by the pivotal connections 332, and movable between a use position with the feet 330 in contact with the floor surface as shown and a storage position with the feet 330 spaced apart from the floor surface 226.

Figure 24:
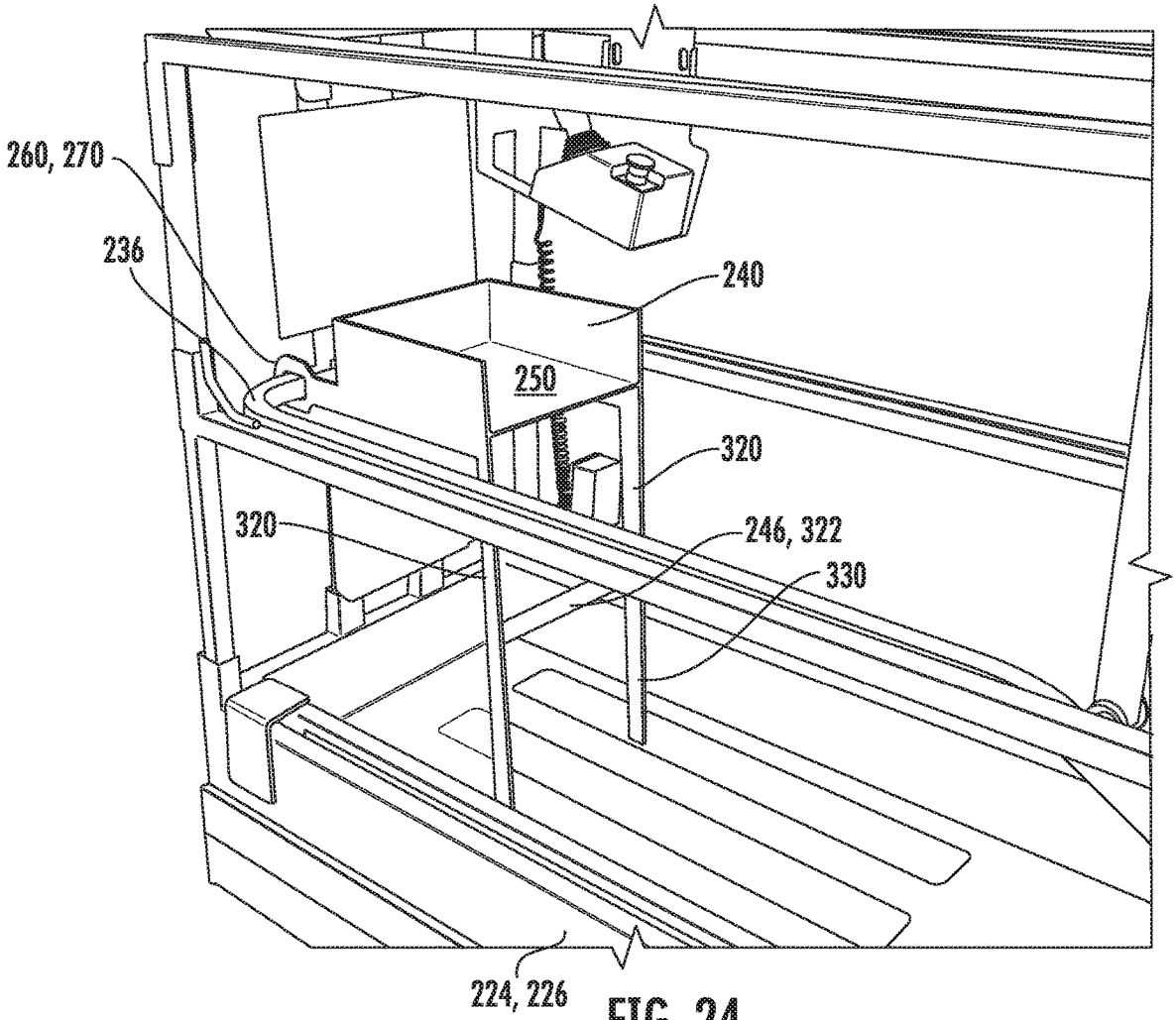
FIG. 24 is a partial perspective view of the aerial lift platform of FIG. 12 with an access deck according to another embodiment.
Figure 25:
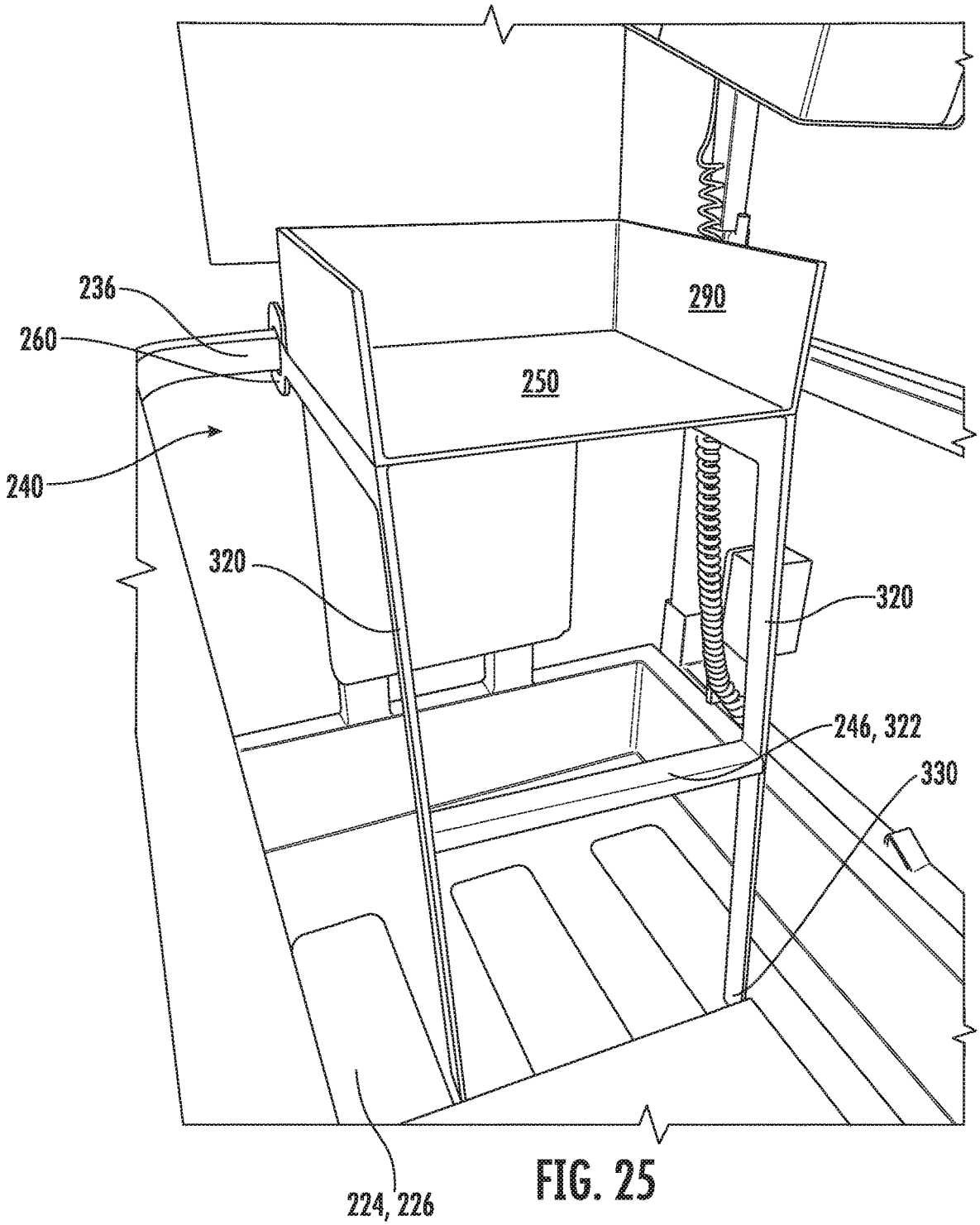
FIG. 25 is another partial perspective view of the aerial lift platform and access deck of FIG. 24.

FIGS. 24-25 illustrate another example of an access deck assembly 240 connected to a mobile platform assembly 224, and is similar to the access deck assembly as described above with respect to FIG. 23. In FIGS. 24-25, the legs 320 of the step 246 are connected to and fixed relative to the base member 250 such that the step 246 cannot rotate or move. In this scenario, the feet 330 may additionally be connected to the floor surface 226 via a mechanical connection such as fasteners, or a chemical or material connection such as a weld or a structural adhesive.

Figure 26:
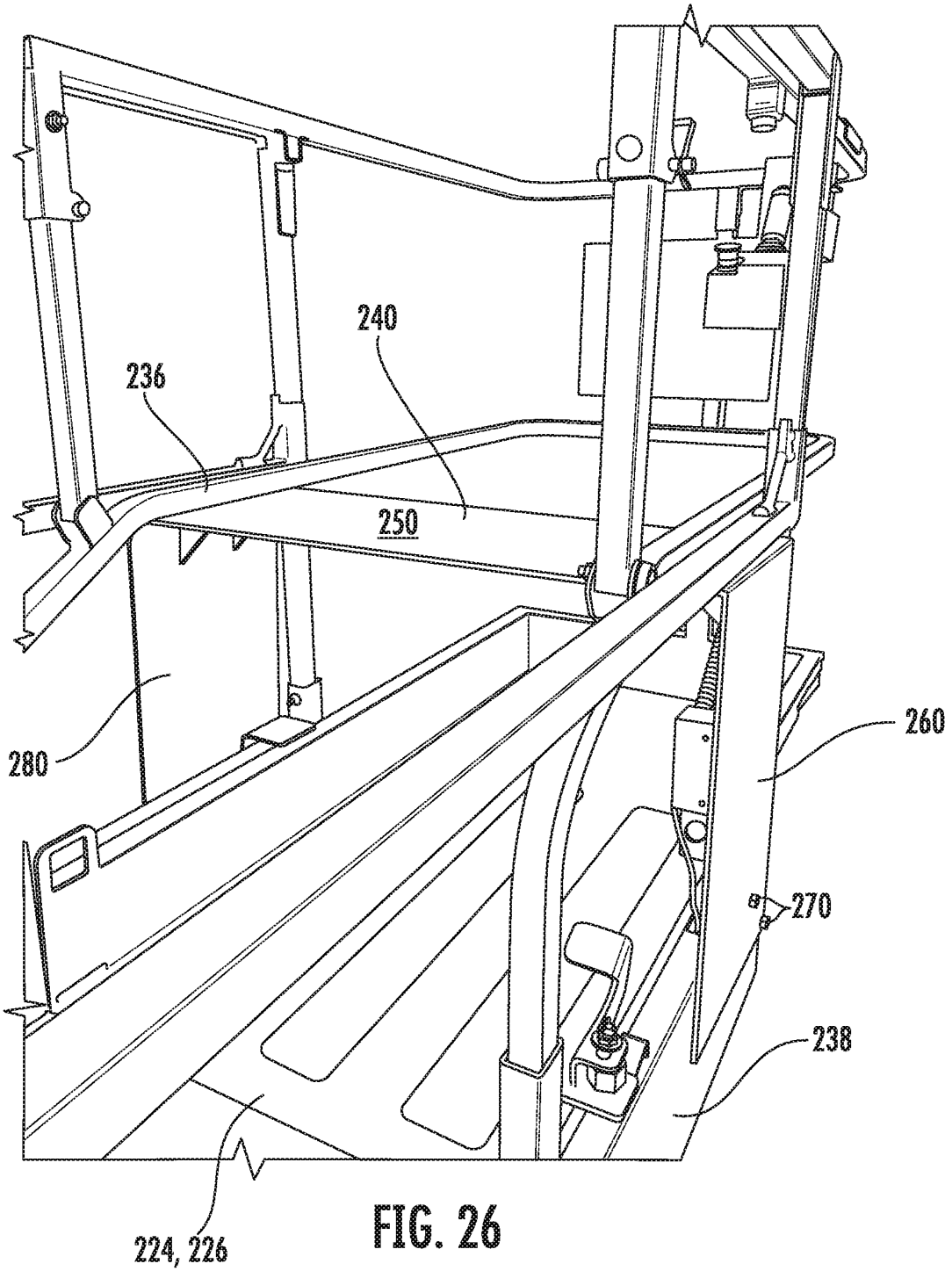
FIG. 26 is a partial perspective view of the aerial lift platform of FIG. 12 with an access deck according to another embodiment.

FIG. 26 illustrates yet another example of access deck assembly 240 according to the present disclosure and connected to a mobile platform assembly 224. The base member 250 provides a surface for an operator to stand on that is elevated relative to and spaced apart from the floor surface 226 of the aerial platform. The access deck assembly 240 may additionally have a step and a handle assembly as described above, or may be provided without the step and/or the handle.

The access deck assembly 240 has first and second guides 260, 280 that are connected to or supported by the base member 250, and are provided as side plates. The first and second guides 260, 280 are spaced apart from one another, and may be adjacent to first and second opposite ends of the base member 250 as shown. Each of the guides 260, 280 is configured to cooperate with and connect to a respective portion of the mobile platform assembly. In the example shown, the guides 260, 280 are connected to an outer surface of the toe guard 238 of the mobile platform assembly 224. In other examples, the guides 260, 280 may connect to another structure of the mobile platform assembly, such as the upper rail, the mid-perimeter rail, or the floor surface. Each of the guides 260, 280 is sized to space the base member 50 at an appropriate height above the floor 226 of the mobile platform assembly 224 for use by the operator.

Locking mechanisms 270 are provided to connect the guides to the rail. The locking mechanisms 270 may be provided by fasteners, such as a bolted connection. In further examples, the locking mechanisms 270 may be provided by a permanent weld to the platform assembly. In even further examples, the locking mechanisms 270 may include a latch or other releasable member.

Various embodiments of the present disclosure have associated, non-limiting advantages. For example, an access deck assembly for a mobile platform on an aerial lift vehicle is provided. The access deck assembly has a base member defining an upper surface sized to support an operator, with the base member supported by the platform assembly of the aerial lift vehicle and is elevated above the floor surface of the mobile platform. The access deck assembly may include an additional feature such as a handle, a rotating step, the ability to fold for transport, a quick release connection to a perimeter rail of the mobile platform, legs to support the base member on the mobile platform floor, a toe guard to prevent objects from falling off the access deck, locking pins to keep a handle or a step in position, or any combination thereof. The access deck assembly attaches to the mobile work platform without the need to modifying any existing platform components, for example, without needing to modify the perimeter frame. In some examples, the access deck assembly may be installed onto the mobile platform assembly without removing an extension deck, or losing the functionality or features provided by the extension deck. The base member of the access deck assembly extends within the confines of the existing platform assembly, e.g. within the perimeter frame, or substantially within the perimeter frame. For example, when the base member is substantially within the perimeter frame, more than 50%, 75%, or 90% of the base member may be positioned within the perimeter frame and that portion of the base member is directly above an existing floor surface of the mobile work platform assembly.

According to one aspect, an access deck assembly for a mobile platform on an aerial lift vehicle is provided with a base member extending from a first end to a second opposite end. The base member defines an upper surface sized to support an operator thereon. At least one hanger guide is supported by the base member and is positioned adjacent to the first end, with the at least one hanger guide forming a channel sized to receive a first portion of a mid-perimeter rail of the mobile platform. At least one support guide is supported by the base member and is positioned adjacent to the second end, with the at least one support guide forming another channel sized to receive a second portion of the mid-perimeter rail of the mobile platform. A locking mechanism is supported by the base member, with the locking mechanism movable to an engaged position to retain the second portion of the mid-perimeter rail within the another channel.

According to a further aspect, the locking mechanism includes a latch member rotatably supported by the base member, with the latch member having an aperture therethrough. The locking mechanism includes a spring-loaded pin supported by the base member. The pin extends through the aperture in the latch member to position the locking mechanism in the engaged position by positioning the latch member across an opening to the another channel.

According to another further aspect, the channel extends longitudinally and the another channel extends vertically relative to the base member.

According to a further aspect, an anchor bracket sized to receive a vertical frame member of the mobile platform. According to an even further aspect, the anchor bracket includes first and second bracket arms, and a locking pin sized to cooperate with first and second apertures defined by the first and second bracket arms, respectively.

According to another further aspect, a step is rotatably connected to the base member. According to an even further aspect, a step locking mechanism is provided to cooperate with the step to locate the step in each of a storage position and a use position.

According to a further aspect, a handle is connected to the base member.

According to another further aspect, a handle assembly is provided to connect to an upper rail of the mobile platform. According to an even further aspect, the handle assembly has a support bracket with a first connection point to connect to the upper rail of the mobile platform and a second connection point to connect to a vertical frame member of the mobile platform. The handle assembly has a handle rotatably connected to the support bracket to move between a use position and a storage position.

According to another aspect, a method of connecting an access deck assembly to a mobile platform of an aerial lift vehicle is provided. A first portion of a mid-perimeter rail of the mobile platform is slid into a channel defined by a hanger guide at a first end of a base member of the access deck assembly. The base member is lowered until a second portion of the mid-perimeter rail is received by another channel defined by a support guide at a second end of the base member. A locking mechanism is engaged to retain the second portion of the mid-perimeter rail within the another channel.

According to a further aspect, an anchor bracket is positioned about a vertical frame member of the mobile platform, and the anchor bracket is supported by the base member of the access deck assembly.

According to another further aspect, a step is moved from a storage position to a use position, the step rotatably connected to the base member.

According to a further aspect, a handle assembly is connected to an upper rail of the mobile platform.

According to an aspect, an access deck assembly for a mobile platform on an aerial lift vehicle is provided with a base member having a substrate extending from a first end to a second opposite end, with the substrate defining an upper surface sized to support an operator thereon and a lower surface opposite to the upper surface. The base member has first and second sidewalls, with each sidewall connected to the lower surface of the substrate and extending longitudinally between the first and second ends. First and second hanger guides are supported by the base member and positioned adjacent to the first end. Each of the first and second hanger guides are sized to receive a first portion of a mid-perimeter rail of the mobile platform and limit translational movement of the access deck assembly relative to the mobile platform along a first axis. First and second support guides are supported by the base member and are positioned adjacent to the second end. Each of the third and fourth support guides are sized to receive a second portion of the mid-perimeter rail of the mobile platform and limit translational movement of the access deck assembly relative to the mobile platform along a second axis. A locking mechanism is supported by the base member, is movable to an engaged position and cooperates with the first support guide to retain the second portion of the mid-perimeter rail within the first support guide. An anchor bracket is supported by the base member. The anchor bracket is sized to receive a vertical frame member of the mobile platform and limit translational movement of the access deck assembly relative to the mobile platform along a third axis.

According to a further aspect, the first, second, and third axes are orthogonal to one another.

According to another further aspect, a step is rotatably connected to the base member and movable between a storage position and a use position. A step locking mechanism is supported by the base member and cooperating with the step to locate the step in each of the storage position and the use position.

According to a further aspect, a handle assembly is provided with a support bracket and a handle rotatably connected to the support bracket to move between a use position and a storage position. The support bracket has a first connection point to connect to the upper rail of the mobile platform and a second connection point to connect to a vertical frame member of the mobile platform.

According to another aspect, an access deck assembly for a mobile platform on an aerial lift vehicle is provided with a base member extending from a first end to a second opposite end. The base member defines an upper surface sized to support an operator thereon. A first guide is supported by the base member and positioned adjacent to the first end, with the first guide sized to cooperate with a first portion of the mobile platform. A second guide is supported by the base member and positioned adjacent to the second end, with the second guide sized to cooperate with a second portion of the mobile platform. A locking mechanism is supported by the base member. The locking mechanism is movable to an engaged position to retain the second portion of the mobile platform between the locking mechanism and the second guide.

According to a further aspect, the first portion and second portion of the mobile platform are provided by a mid-perimeter rail. The first guide forms a channel sized to receive the mid-perimeter rail of the mobile platform.

According to another further aspect, a handle assembly is connected to the base member. The handle assembly has first and second legs, a cross-member extending between and connected to the first and second legs, a hanging bracket supported by the cross-member, and an upper handle rotatably connected to the first and second legs. The hanging bracket is sized to cooperate with an upper perimeter rail of the mobile platform.

According to an even further aspect, the handle assembly has a first storage position, a second upright position with the upper handle adjacent to the legs, and a third use position with the upper handle extending outwardly from the legs for grasping by an operator. According to an even yet further aspect, the base member has a toe guard extending around a portion of the perimeter of the base member and transversely to the upper surface, with the upper surface of the base member defining a first pair of apertures extending therethrough, the toe guard defining a second pair of apertures extending therethrough, the first and second legs extending through the first pair of apertures in the second position, and the first and second legs extending through the second pair of apertures in the first position. According to a yet even yet further aspect, an end region of each of the first and second legs defines an elongated slot, and the base member has first and second pins extending through the slots of the first and second legs to connect the handle assembly to the base member.

According to another even yet further aspect, a locking pin is supported by the base member and is configured to cooperate with the first leg to selectively retain the handle assembly in the first position or the second position.

According to an even yet further aspect, a carrying handle is supported by the cross-member of the handle assembly.

According to a further aspect, a step is rotatably connected to the base member.

According to another further aspect, the locking mechanism has a latch member supported for translation relative to the base member and is movable from an engagement position to a disengagement position. A spring element biases the latch member towards the engagement position. According to an even further aspect, the latch member defines an inclined face shaped to cooperate with the mobile platform to move the latch member to the disengagement position in response to the inclined face contacting the mobile platform.

According to a further aspect, the first guide extends transversely along the base member, and the first guide has first and second ends connected to the base member at an offset distance from an associated end of the base member. A bracket connects an intermediate location of the guide to the base member. According to an even further aspect, the guide extends towards the associated end of the base member in the intermediate location such that an edge of the guide in the intermediate location is co-planar with the associated end of the base member.

According to another further aspect, the second guide defines a locating feature configured to cooperate with the second portion of the mobile platform to locate the access deck assembly.

According to an aspect, a method of connecting an access deck assembly to a mobile platform of an aerial lift vehicle is provided. A first portion of a mid-perimeter rail of the mobile platform is slid into a channel defined by a first guide at a first end of a base member of the access deck assembly. The base member is lowered until a second portion of the mid-perimeter rail is received by a second guide at a second end of the base member. A locking mechanism is engaged to retain the second portion of the mid-perimeter rail between a latch member of the locking mechanism and the second guide.

According to a further aspect, a handle assembly is moved from a first storage position to a second upright position. The first position has an upper handle of the handle assembly adjacent to the base member and folded into first and second legs of the handle assembly. The second position has a hanging bracket of handle assembly cooperating with an upper perimeter rail of mobile platform and with the upper handle spaced apart from the base member and folded into first and second legs. According to an even further aspect, the handle assembly is moved from the second upright position to a third use position. The third position has the hanging bracket cooperating with the upper perimeter rail of mobile platform and the upper handle unfolded from the first and second legs for grasping by an operator. According to an even yet further aspect, the handle assembly is moved from the first position to the second position by translating the handle assembly relative to the base member in a first plane, pivoting the handle assembly relative to the base member, and translating the handle assembly relative to the base member in a second plane.

According to a further aspect, a step is moved from a storage position to a use position, the step rotatably connected to the base member.

While various embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. An access deck assembly and mobile platform arrangement for an aerial lift vehicle, the arrangement comprising:

a mobile platform for mounting on the aerial lift vehicle; and an access deck assembly mountable on the mobile platform, the access deck assembly including:

a base member extending from a first end to a second opposite end, the base member defining an upper surface sized to support an operator thereon;

a first guide supported by the base member, the first guide sized to cooperate with a first portion of the mobile platform, wherein the first guide limits translational movement of the access deck assembly relative to the mobile platform along a first axis;

a second guide supported by the base member, the second guide sized to cooperate with a second portion of the mobile platform, wherein the second guide limits translational movement of the access deck assembly relative to the mobile platform along a second axis orthogonal to the first axis;

a locking mechanism supported by the base member, the locking mechanism having a latch member supported for sliding translation relative to the base member, the latch member movable from a disengaged position to an engaged position to retain the second portion of the mobile platform between the latch member and the second guide; and a step rotatably connected to the base member.

2. The access deck assembly and mobile platform arrangement of claim 1 wherein the latch member defines an inclined face shaped to cooperate with the mobile platform to move the latch member to the disengagement position in response to the inclined face contacting the mobile platform, wherein the inclined face faces away from the base member.

3. The access deck assembly and mobile platform arrangement of claim 1 further comprising a handle assembly connected to the base member.

4. The access deck assembly and mobile platform arrangement of claim 3 wherein the handle assembly has first and second legs, a cross-member extending between and connected to the first and second legs, a hanging bracket extending outwardly from the cross-member, and an upper handle rotatably connected to the first and second legs, wherein the hanging bracket is sized to cooperate with an upper perimeter rail of the mobile platform.

5. The access deck assembly and mobile platform arrangement of claim 1 further comprising a handle assembly to connect to an upper rail of the mobile platform.

6. The access deck assembly and mobile platform arrangement of claim 5 wherein the handle assembly has a support bracket with a first connection point to connect to the upper rail of the mobile platform and a second connection point to connect to a vertical frame member of the mobile platform; and wherein the handle assembly has a handle rotatably connected to the support bracket to move between a use position and a storage position.

7. The access deck assembly and mobile platform arrangement of claim 1 wherein the first portion and second portion of the mobile platform are provided by a mid-perimeter rail; and wherein the first guide forms a channel sized to receive the first portion of the mid-perimeter rail of the mobile platform.

8. The access deck assembly and mobile platform arrangement of claim 7 wherein the second guide forms another channel sized to receive the second portion of the mid-perimeter rail of the mobile platform.

9. The access deck assembly and mobile platform arrangement of claim 7 wherein the second guide defines a locating feature configured to cooperate with the second portion of the mobile platform to locate the access deck assembly.

10. The access deck assembly and mobile platform arrangement of claim 1 wherein the first guide is configured to connect to a mid-perimeter rail of the mobile platform, an upper rail of the mobile platform, or a lower toe guard of the mobile platform.

11. The access deck assembly and mobile platform arrangement of claim 1 further comprising a handle assembly supported by the mobile platform adjacent to the base member, the handle assembly extending from the mobile platform away from the base member.

12. The access deck assembly and mobile platform arrangement of claim 11 wherein the handle assembly is moveable relative to the mobile platform from a retracted position to an extended position.

13. The access deck assembly and mobile platform arrangement of claim 1 further comprising a toe guard extending along at least a portion of a perimeter of the base member.

14. The access deck assembly and mobile platform arrangement of claim 1 wherein the base member is positioned substantially within a perimeter frame of the mobile platform.

15. The access deck assembly and mobile platform arrangement of claim 1 wherein the step has a pair of arms, and a tread member extending between the arms, and wherein the step has a flange extending outwardly from one of the arms, the flange positioned to cooperate with the upper surface of the base member when the step is in an unfolded, use position.

16. An access deck assembly for a mobile platform on an aerial lift vehicle, the assembly comprising:

a base member extending from a first end to a second opposite end, the base member defining an upper surface sized to support an operator thereon;

a first guide supported by the base member, the first guide sized to cooperate with a first portion of the mobile platform;

a second guide supported by the base member, the second guide sized to cooperate with a second portion of the mobile platform; and a locking mechanism supported by the base member, the locking mechanism movable to an engaged position to retain the second portion of the mobile platform between the locking mechanism and the second guide;

a handle assembly connected to the base member, wherein the handle assembly has first and second legs, a cross-member extending between and connected to the first and second legs, a hanging bracket supported by the cross-member, and an upper handle rotatably connected to the first and second legs, wherein the hanging bracket is sized to cooperate with an upper perimeter rail of the mobile platform;

wherein the handle assembly has a first storage position, a second upright position with the upper handle adjacent to the first and second legs, and a third use position with the upper handle extending outwardly from the first and second legs for grasping by an operator; and wherein the access deck assembly further comprises a locking pin supported by the base member and configured to cooperate with the first leg to selectively retain the handle assembly in the first storage position or the second upright position.

17. An access deck assembly and mobile platform arrangement for an aerial lift vehicle, the assembly comprising:

a mobile platform for mounting on the aerial lift vehicle; and an access deck assembly mountable on the mobile platform, the access deck assembly including:

a base member extending from a first end to a second opposite end, the base member defining an upper surface sized to support an operator thereon;

a first guide supported by the base member, the first guide sized to cooperate with a first portion of the mobile platform, wherein the first guide extends along and is spaced apart from a lower surface of the base member thereby defining a channel therebetween to receive the first portion of the mobile platform;

a second guide supported by the base member, the second guide sized to cooperate with a second portion of the mobile platform;

a locking mechanism supported by the base member, the locking mechanism having a latch member supported for sliding translation relative to the base member, the latch member movable from a disengaged position to an engaged position to retain the second portion of the mobile platform between the latch member and the second guide; and a step rotatbly connected to the base member.

18. The access deck assembly and mobile platform arrangement of claim 17 wherein the channel is a U-shaped channel.

* * * * *